US008998020B2

(12) United States Patent
Sato et al.

(10) Patent No.: US 8,998,020 B2
(45) Date of Patent: Apr. 7, 2015

(54) DOUBLE CONTAINER, INNER CONTAINER, AND OUTER CONTAINER

(75) Inventors: Tatsuo Sato, Kanagawa (JP); Kenji Oohashi, Kanagawa (JP); Yoshikazu Matsumiya, Saitama (JP)

(73) Assignee: Shiseido Company, Ltd., Tokyo (JP)

( * ) Notice: Subject to any disclaimer, the term of this patent is extended or adjusted under 35 U.S.C. 154(b) by 307 days.

(21) Appl. No.: 13/145,820

(22) PCT Filed: Jan. 28, 2010

(86) PCT No.: PCT/JP2010/051151

§ 371 (c)(1),
(2), (4) Date: Jul. 22, 2011

(87) PCT Pub. No.: WO2010/087408

PCT Pub. Date: Aug. 5, 2010

(65) Prior Publication Data

US 2011/0272410 A1 Nov. 10, 2011

(30) Foreign Application Priority Data

Jan. 30, 2009 (JP) ..... 2009-019998
Jul. 13, 2009 (JP) ..... 2009-164505
Jan. 22, 2010 (JP) ..... 2010-011639

(51) Int. Cl.
*B65D 85/00* (2006.01)
*B65D 77/04* (2006.01)

(52) U.S. Cl.
CPC ..... *B65D 77/0486* (2013.01); *B65D 77/0493* (2013.01)

(58) Field of Classification Search
CPC .. B05B 7/2408; B05B 7/2478; B05B 7/2481; B05B 11/0043; B05B 11/3047; B05B 11/0048; B05B 11/3001; B05B 11/3074; B05B 11/0013; B05B 11/0016; B05B 11/0067; B05B 11/0072; B05B 11/0097; B05B 11/3032; B05B 11/3025; B05B 11/3028; B05B 11/3036; B05B 11/3067; B05B 11/3077; B05B 11/3081; B05B 15/005; B65D 1/0215; B65D 11/06; B65D 21/0209; B65D 23/0885; B65D 25/34; B65D 47/2031; B65D 47/2075; B65D 47/32; B65D 55/06; B65D 55/10; B65D 75/5883; B65D 77/0486; B65D 77/0493; B65D 77/06; B65D 81/24; B65D 81/3841; B65D 83/0055; B65D 83/0061; B65D 83/62; B65D 2231/004; B65D 2583/005
USPC ..... 215/10; 220/23.83, 23.87, 23.89; 222/96, 105–106, 142.5, 399
IPC ..... B65D 77/00, 77/04, 77/06, 83/00, 83/76
See application file for complete search history.

(56) References Cited

U.S. PATENT DOCUMENTS 3,561,632 A * 2/1971 Shirae ..... 215/315
3,876,115 A * 4/1975 Venus et al. ..... 222/183

(Continued)

FOREIGN PATENT DOCUMENTS

EP 571140 A1 * 11/1993
EP 880929 A2 * 12/1998

(Continued)

OTHER PUBLICATIONS

International Search Report mailed on Mar. 9, 2010.

(Continued)

*Primary Examiner* — Bryon Gehman
*Assistant Examiner* — Brijesh V. Patel
(74) *Attorney, Agent, or Firm* — IPUSA, PLLC

(57) ABSTRACT

An inner container is to be installed inside an outer container, the inner container including a jointed portion configured to joint a jointing portion formed in the outer container to prevent the inner container from being separated from the outer container when the inner container is installed in the outer container; and a second engaging portion engaged with a first engaging portion formed in the outer container and configured to prevent the inner container from rotating relative to the outer container.

1 Claim, 31 Drawing Sheets

(56) References Cited

U.S. PATENT DOCUMENTS

| | | | | | |
|---|---|---|---|---|---|
| 5,099,998 | A | * | 3/1992 | Curzon et al. | 206/514 |
| 5,123,571 | A | * | 6/1992 | Rebeyrolle et al. | 222/105 |
| 5,292,033 | A | * | 3/1994 | Gueret | 222/105 |
| 5,299,705 | A | * | 4/1994 | Dettmar | 220/23.83 |
| 5,305,921 | A | * | 4/1994 | Kock et al. | 222/105 |
| 5,509,584 | A | * | 4/1996 | Gueret | 222/321.7 |
| 5,630,531 | A | * | 5/1997 | Gaucher | 222/105 |
| 5,813,571 | A | * | 9/1998 | Gaucher | 222/105 |
| 6,536,620 | B2 | * | 3/2003 | Moran | 215/396 |
| 6,764,622 | B2 | * | 7/2004 | Moran | 264/46.5 |
| 6,945,419 | B2 | * | 9/2005 | Bertazza et al. | 220/23.87 |
| 2001/0010314 | A1 | * | 8/2001 | Goto et al. | 220/674 |
| 2004/0112921 | A1 | * | 6/2004 | Nomoto et al. | 222/321.9 |
| 2005/0040182 | A1 | * | 2/2005 | Suzuki | 222/105 |
| 2005/0258126 | A1 | * | 11/2005 | Canamasas Puigbo | 215/12.1 |
| 2008/0011879 | A1 | * | 1/2008 | Gerson et al. | 239/337 |
| 2008/0230540 | A1 | | 9/2008 | Marra et al. | |
| 2010/0102086 | A1 | * | 4/2010 | Rabinovitch | 222/105 |
| 2010/0264166 | A1 | * | 10/2010 | Moretti | 222/105 |

FOREIGN PATENT DOCUMENTS

| | | | | |
|---|---|---|---|---|
| EP | 2153908 | A1 | * | 2/2010 |
| FR | 2853633 | A1 | * | 10/2004 |
| JP | 05-75163 | | | 10/1993 |
| JP | 05-75165 | | | 10/1993 |
| JP | 05-075165 | U | * | 10/1993 |
| JP | 05-84620 | | | 11/1993 |
| JP | 06-20273 | | | 3/1994 |
| JP | 06-78274 | | | 11/1994 |
| JP | 10-258875 | | | 9/1998 |
| JP | 2001-341780 | | | 12/2001 |
| JP | 2008-087768 | | | 4/2008 |
| JP | 2008087768 | A | * | 4/2008 |
| JP | 2008-189315 | | | 8/2008 |
| JP | 2009107705 | A | * | 5/2009 |
| JP | 2010241505 | A | * | 10/2010 |
| WO | WO88/05596 | A1 | | 7/1988 |

OTHER PUBLICATIONS

Extended European search report mailed Dec. 20, 2012.

* cited by examiner

FIG.28

| t(mm) | 0.03 | 0.05 | 0.10 | 0.20 | 0.25 | 0.30 | 0.35 |
|---|---|---|---|---|---|---|---|
| STRENGTH | × | ○ | ○ | ◎ | ◎ | ◎ | ◎ |
| WEIGHT | ◎ | ◎ | ○ | ○ | ○ | ○ | × |

FIG.29

| w(mm) | 0.23 | 0.25 | 0.5 | 1.0 | 2.0 | 3.0 | 3.5 | 4.0 | 4.3 |
|---|---|---|---|---|---|---|---|---|---|
| RIGIDITY | × | × | ○ | ○ | ○ | ○ | ◎ | ◎ | ◎ |
| WEIGHT | ◎ | ◎ | ◎ | ○ | ○ | ○ | ○ | ○ | × |

DOUBLE CONTAINER, INNER CONTAINER, AND OUTER CONTAINER

TECHNICAL FIELD

The present invention relates to a double container, an inner container, and an outer container, and more specifically, to a double container formed by temporarily jointing two containers provided by overlapping the two containers, an inner container, and an outer container.

BACKGROUND ART

A double container ordinarily accommodates an inner container inside an outer container. The double container can have an inner container exchange relative to the outer container. Therefore, the outer container can be reused. Therefore, only the outer appearance of the outer container can be improved, and the inner container installed inside the outer container is a refill container to be disposed of. Therefore, the size of the inner container 12, 42 can be reduced. Thus, a load on the earth's environment can be reduced.

An example of a dispenser container for discharging a content by a predetermined amount is exemplified. When the conventional dispenser container having an ordinary double container structure is fixed to a dispenser (constant delivery pump) by screws, a threading force with the screws causes the inner container to be fixed to the outer container (see Patent Document 1).

When the inner container is exchanged in the dispenser container, the dispenser container is first turned to remove the dispenser device from the outer container. With this, the inner container can be removed from the outer container, and the used inner container is removed from the outer container and disposed of. Subsequently, a new inner container is positioned at an installing position of the inner container and the dispenser device is threadably mounted on the outer container while maintaining the position of the new inner container in the outer container. As described the inner container is exchanged relative to the outer container.

RELATED ART

Patent Document

[Patent Document 1] Japanese Laid Open Patent Publication No. 2008-189315

DISCLOSURE OF THE INVENTION

Problems to be Solved by the Invention

A cap is installed in an opening of the inner container as the refill container to prevent the contents of the inner container from leaking out of the inner container. Further, by forming a thread in a periphery of the opening and screwing the cap in the thread, the contents can be securely prevented from leaking.

Therefore, as one method, before the new inner container is installed in the outer container, or after the new inner container is installed in the outer container and before the dispenser device is threadably mounted on the inner container, the cap needs to be removed from the inner container. However, the contents may fly out of the inner container when the cap is removed before the new inner container is installed in the outer container.

On the other hand, in a method where the cap is removed after the inner container is installed in the outer container, because the inner container is not fixed to the outer container, the inner container rotates as the outer container rotates along with the rotation of the cap. Thus, it is difficult to remove the cap. Therefore, there is a problem in the above methods that operability in installing the inner container in the outer container is insufficient.

According to the present invention, a double container having improved operability in exchanging an inner container, the inner container and an outer container are provided in consideration of the above.

Means for Solving the Problem

According to the first aspect, the above problem may be solved by providing a double container including a first container; a second container installed inside the first container; a temporarily jointing mechanism configured to temporarily joint the second container to the first container when the second container is installed inside the first container; and a rotation preventing mechanism configured to preventing rotation of the second container relative to the first container when the second container is installed inside the first container.

According to the second aspect, the above problem may be solved by providing an inner container installed inside an outer container and including a jointed portion jointed to a joining portion which is provided in the outer container to prevent separation of the inner container from the outer container when the inner container is installed in the outer container; and a second engaging portion which is engaged with a first engaging portion provided in the outer container when the inner container is installed in the outer container to prevent rotation of the inner container relative to the outer container.

According to the third aspect, the above problem may be solved by providing an outer container in which an inner container is installed and includes a jointing portion jointed to a joined portion which is provided in the inner container to prevent separation of the inner container from the outer container when the inner container is installed in the outer container; and a second engaging portion which is engaged with a first engaging portion provided in the inner container when the inner container is installed in the outer container to prevent rotation of the inner container relative to the outer container.

Effect of the Invention

The disclosed double container can prevent the second container (the inner container) from being separated from the first container (the outer container) when the second container is installed in the first container, and simultaneously the second container can be prevented from being rotated inside the first container.

BRIEF DESCRIPTION OF DRAWINGS

FIG. 28 illustrates an experimented result of changes in the strength and weight when the wall thickness of a container body is changed.

FIG. 29 illustrates an experimented result of changes in the strength when the wall thickness of a tubular portion is changed.

BEST MODE FOR CARRYING OUT THE INVENTION

Figure 1:
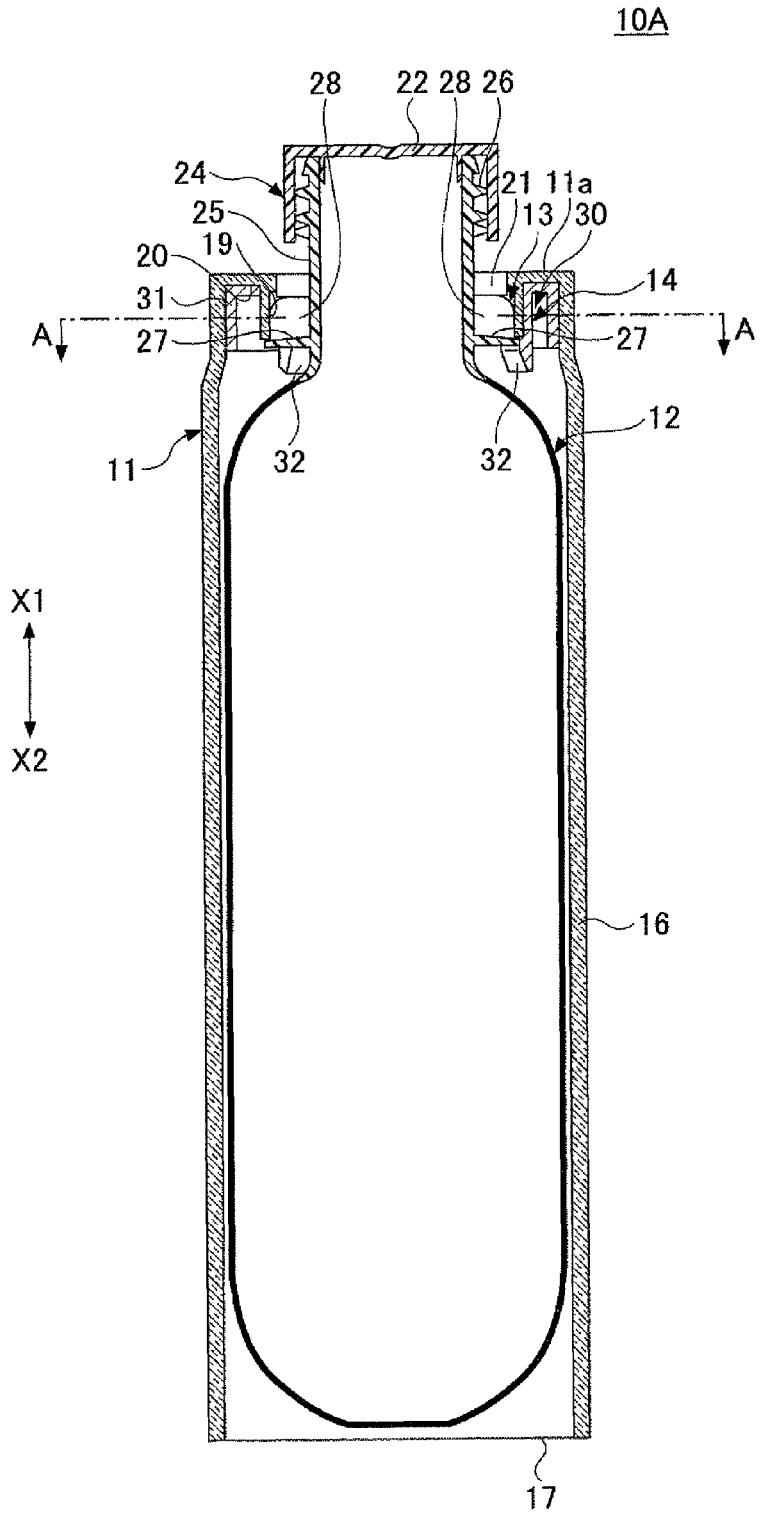
FIG. 1 is a cross-sectional view of a double container of Embodiment 1 of the present invention.

A description of the embodiments is given below with reference to the figures. Although hatching of constituent elements indicated in the figures may correspond to example materials, materials to be actually used are not limited to the corresponding example materials. Usable materials may be appropriately used for the constituent elements.

FIG. 1 thru FIG. 4 illustrate a double container 10A of Embodiment 1 of the present invention. The double container 10A includes an outer container 11, an inner container 12, a temporarily jointing mechanism 13 and a rotation preventing mechanism 14. Although Embodiment 1 describes the double container 10A as a cosmetic container in which a dispenser device is installed, the present invention is not limited to application to the cosmetic container, and can be applied to other various containers. In figures, an arrow X1 designates an upward direction, and an arrow X2 designates a downward direction.

The outer container 11 is shaped substantially like a cylinder. In Embodiment 1, a material of the outer container 11 is a resin. However, the material of the outer container 11 is not limited to the resin, and other materials such as glass and ceramics maybe used. The outer container 11 includes a cylindrical body 16, a bottom opening 17, an installing neck 18, a rotation preventing recess 19 and a fixing concave 20.

The cylindrical body 16 described below is shaped like a cylinder. The lower end of the cylindrical body 16 is opened to thereby form the bottom opening 17. The inner container 12 is inserted into the cylindrical body 16 from the bottom opening 17. In Embodiment 1, the bottom opening 17 is formed in the bottom end of the cylindrical body 16. However, a bottom lid may be formed to stem the bottom opening 17.

The cylindrical body 16 is used for a long time without being scrapped unlike the inner container 12 functioning as a refill container. Therefore, the cylindrical body 16 may be designed to improve appearance of its outer periphery.

The installing neck 18 is formed on the upper end of the cylindrical body 16. The installing neck 18 is an annular wall inside which an opening 21 is formed. An installing unit 24 of the inner container 12 is inserted into the opening 21. The installing unit 24 is installed on the installing neck 18.

Figure 3:
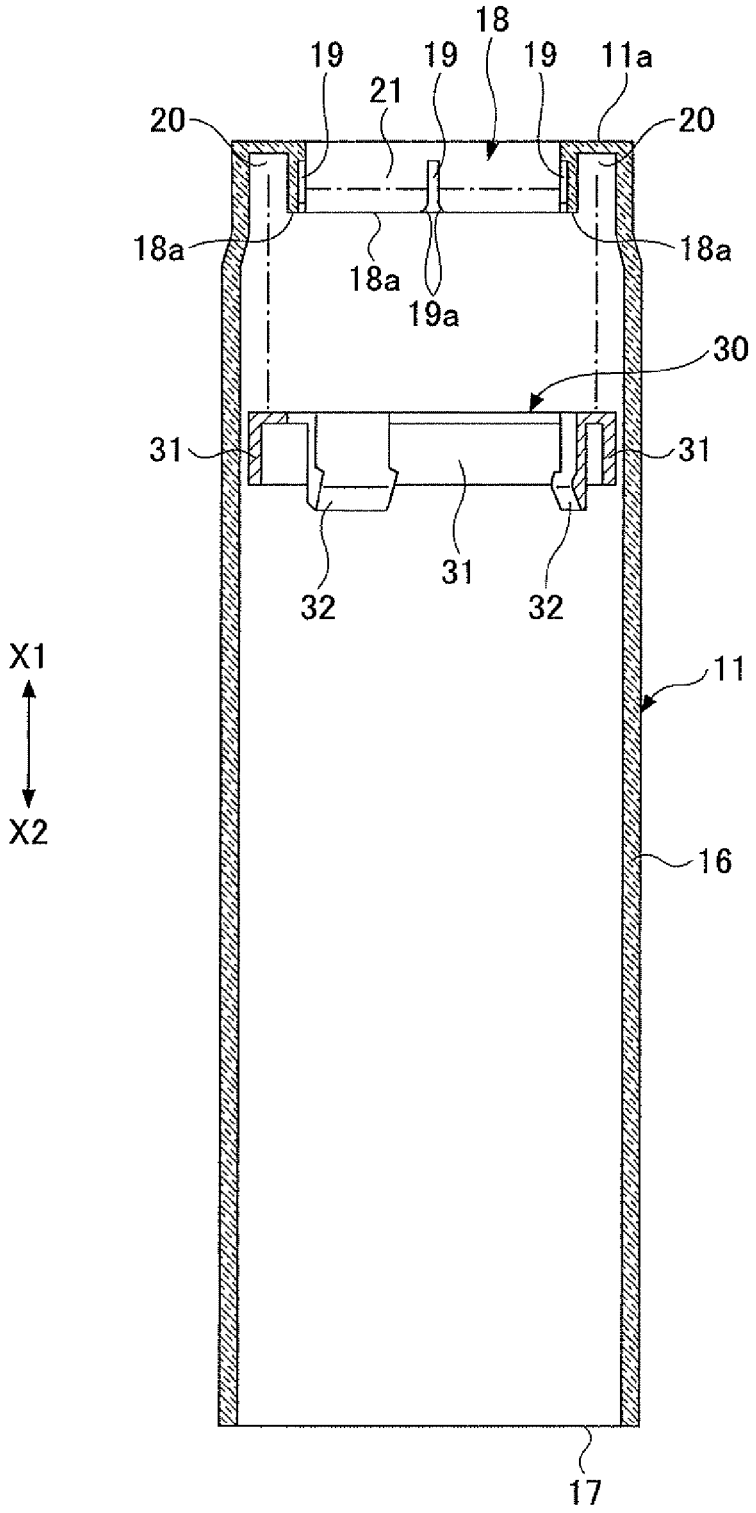
FIG. 3 is a cross-sectional view of an outer container of the double container of Embodiment 1 of the present invention illustrating an enlarged temporarily jointing member of the outer container.

The installing neck 18 has a diameter smaller than that of the cylindrical body 16. Referring to FIG.3, the fixing concave 20 is formed to fix a temporarily jointing member 30 described below to a space between the cylindrical body 16 and the installing neck 18. The inner peripheral diameter of the installing neck 18 is larger than the diameter of a cap 22 attached to the inner container 12.

Figure 4:
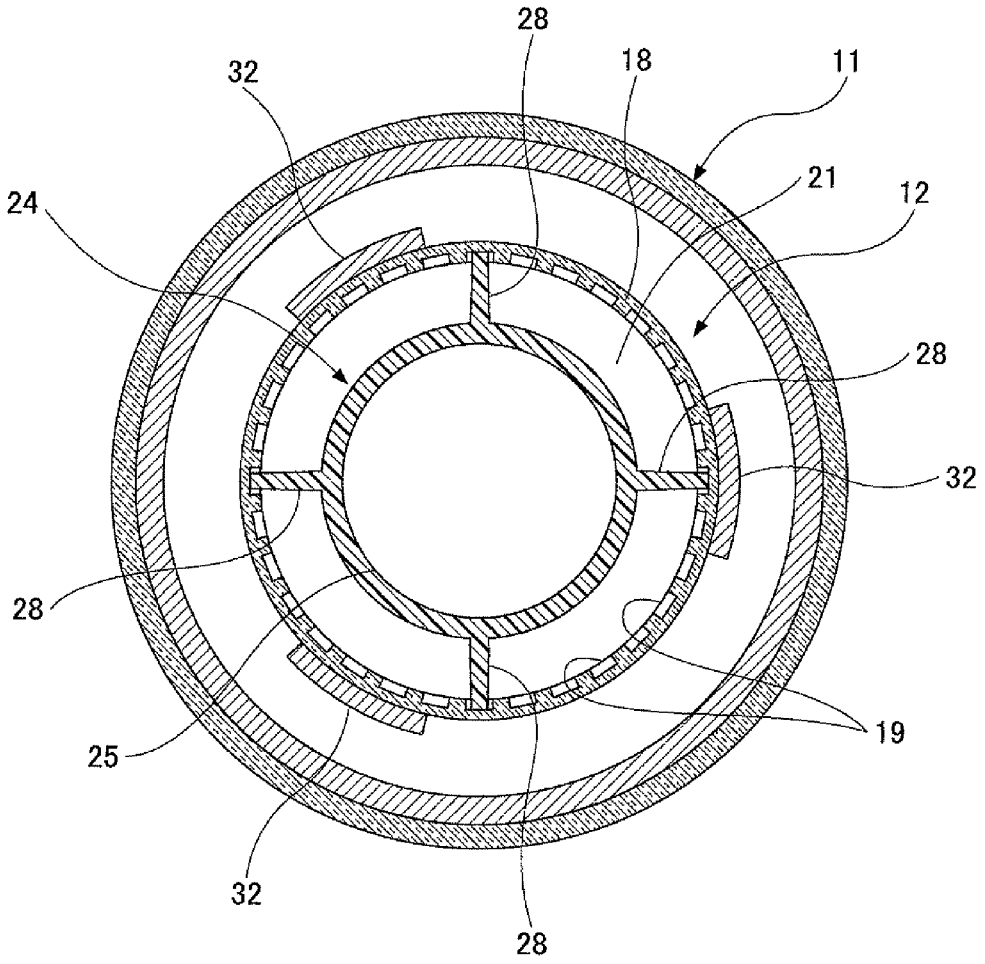
FIG. 4 is a cross-sectional view taken along a line A-A of FIG. 1.

The plural rotation preventing recesses 19 are formed on the inner peripheral surface of the installing neck 18 facing the opening 21. The rotation preventing recess 19 is formed to extend in directions (X1 and X2 in FIG. 3) of installing and detaching the inner container 12 on and from the outer container 11. The rotation preventing recesses 19 are arranged on the inner peripheral surface of the installing neck 18 at predetermined intervals as illustrated in FIG. 4. Specifically, the number of the rotation preventing recesses 19 is thirty-six 36 when the pitches are 10° of the inner peripheral surface. A tapered portion 19*a* is formed on the lower end portion of the rotation preventing recesses 19 as illustrated in FIG. 3.

The material of the temporarily jointing member 30 is a metal, a resin or the like having a function of a spring. The temporarily jointing member 30 is fixed to the fixing concave 20 of the outer container 11 as illustrated in FIG. 3. The temporarily jointing member 30 has a fixing portion 31 and temporarily jointing hooks 32. The fixing portion 31 is shaped like a ring and fixed to the fixing concave 20. The fixing portion 31 may be fixed to the fixing concave 20 with a bonding material. However, fixing of the fixing portion 31 to the fixing concave 20 is not limited to this. The fixing portion 31 may be press fit into the fixing concave 20, or fit using an inserting formation method when the outer container 11 is made of the resin.

The temporarily jointing hooks 32 extend downward in the direction X2 from the fixing portion 31 like a cantilever arm. Since the temporarily jointing member 30 is made of the material having the spring function, the temporarily jointing hooks 32 extending from the fixing portion 31 may be elastically deformable. The temporarily jointing hooks 32 are positioned inside the installing neck 18 formed in the outer container 11 while the temporarily jointing member 30 is fixed to the fixing concave 20. The temporarily jointing mechanism 13 includes the temporarily jointing hooks 32 and a flange 27 which is formed in the inner container 12.

Next, the inner container 12 is described. The outer container 11 is a so-called externally furnishing container which is continuously used even after its contents are completely ejected. On the contrary, the inner container 12 is a refill container which is exchanged after the contents are completely ejected. The inner container 12 includes a container body 23 and the installing unit 24.

The container body 23 has a thin-walled tube-like shape inside which the contents (cosmetics in Embodiment 1) are accommodated. The thickness (t) the container body 23 is set to be 0.05 mm≤t≤0.3 mm.

The installing unit 24 is integrally formed with the container body 23 in its upper portion. The installing unit 24 includes a tubular portion 25, a screw portion 26, the flange 27 and a rotation preventing ribs 28.

The tubular portion 25 has a thickness greater than that of the container body 23. Therefore, the rigidity of the tubular portion 25 is higher than that of the container body 23. Specifically, the thickness (w) of the tubular portion 25 of the installing unit 24 is set to be 0.5 mm≤w≤4.0 mm.

An opening 29 is formed inside the tubular portion 25. The contents of the container body 23 may be taken out of the opening 29. The screw portion 26 is screwed with the cap 22 which seals the opening 29 or the dispenser device 90 described below.

The flange 27 is positioned in a lower portion of the installing unit 24, extends outward, and has an annular shape. The outer periphery diameter of the flange 27 is larger than the most inner diameter of the installing neck 18 of the outer container 11. Therefore, when the inner container 12 is inserted into the outer container 11 as described below, the flange 27 is in contact with the installing neck 18.

The number of the rotation preventing ribs 28 are plural. The plural rotation preventing ribs 28 are formed on an upper portion of the flange 27. In Embodiment 1, four rotation preventing ribs 28 are formed at intervals of 90° as illustrated in FIG. 4. The rotation preventing ribs 28 are plate-like ribs. The lower edges of the rotation preventing ribs 28 are integrally formed with the flange 27, and the inner side edges are integrally formed with the tubular portion 25. The rotation preventing ribs 28 may be engaged with the rotation preventing recesses 19 formed in the installing neck 18 of the outer container 11.

The temporarily jointing mechanism 13 includes the temporarily jointing hooks 32 and the flange 27 formed in the inner container 12. As described above, when the inner container 12 is inserted into the outer container 11, the flange 27 is in contact with the installing neck 18 since the flange 27 is larger than the inner size of the installing neck 18. Before the flange 27 is in contact with the installing neck 18, the flange 27 climbs over a protrusion of the temporarily jointing hooks 32, the flange 27 is in contact with its lower end portion 18*a*, and the temporarily jointing hooks 32 are jointed with the flange 27.

The temporarily jointing hook 32 is made of a material having a spring function and is a cantilever arm. Therefore, the temporarily jointing hooks 32 are elastically deformed toward an outside when the flange 27 climbs over the temporarily jointing hooks 32. After the flange 27 climbs over the temporarily jointing hooks 32, the temporarily jointing hooks 32 elastically return to an original state.

In the jointed state, an upper surface of the flange 27 is in contact with the lower end portion (illustrated in FIG. 3) of the installing neck 18. The lower surface of the flange 27 is jointed with the temporarily jointing hooks 32. Therefore, the inner container 12 is temporarily jointed to the outer container 11 by the temporarily jointing mechanism 13.

The state of being temporarily jointed continues until the inner container 12 is finally fixed to the outer container 11 by a dispenser device 90. Under the state of being temporarily jointed, it may be possible to remove the inner container 12 from the outer container 11 when the inner container 12 is pulled with a jointing force of the temporarily jointing hooks 32 and the flange 27 or more. However, if only a force smaller than the jointing force is applied, the inner container 12 is kept jointed to the outer container 11.

The rotation preventing mechanism 14 includes the rotation preventing recesses 19 formed in the installing neck 18, and the rotation preventing ribs 28 formed on the flange 27. When the inner container 12 is inserted into the outer container 11, the rotation preventing ribs 28 face the installing neck 18 having many rotation preventing recesses 19. At this time, the rotation preventing ribs 28 are engaged with any of the rotation preventing recesses 19.

The rotation preventing recesses 19 and the rotation preventing ribs 28 extend in vertical directions X1 and X2. Therefore, when the rotation preventing ribs 28 are engaged with the rotation preventing recesses 19, rotation of the inner container 12 relative to the outer container 11 is stopped. Then, if a rotational force is applied to the outer container 11 or the inner container 12, the inner container 12 may not rotate inside the outer container 11.

Subsequently, an operation of installing the inner container 12 in the outer container 11 and an operation of separating the inner container 12 from the outer container 11 in the double container 10A are described.

Figure 2:
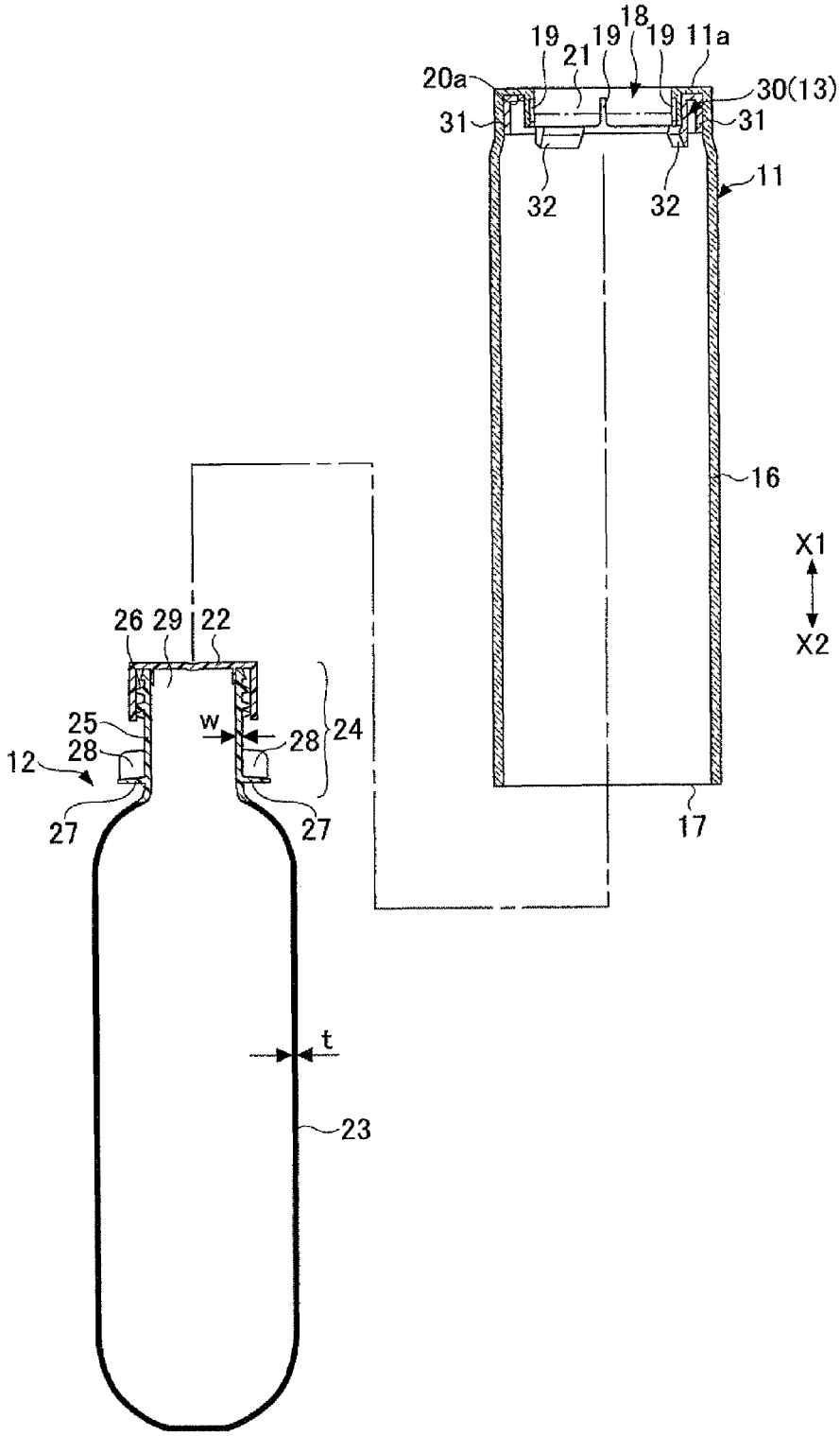
FIG. 2 is an exploded view of the double container of Embodiment 1 of the present invention.

In order to install the inner container 12 in the outer container 11, the inner container 12 is inserted into the cylindrical body 16 of the outer container 11 from the bottom opening 17 as illustrated in FIG. 2. In Embodiment 1, the inner container 12 is inserted from a bottom portion of the outer container 11. When the inner container is inserted, the cap is screwed on with the screw portion 26 to prevent the contents of the container body 23 from leaking outside.

The outer diameter of the cap 22 is smaller than the inner diameter of the installing neck 18. Therefore, the tubular portion 25 including the cap 22 can be inserted in the opening 21 of the installing neck 18 of the outer container 11. When the inner container 12 is inserted, the rotation preventing ribs 28 face the installing neck 18.

Since a large number of the rotation preventing recesses 19 are formed on the inner periphery of the installing neck 18, the rotation preventing ribs 28 move into the rotation preventing recesses 19 and are engaged with the rotation preventing recesses 19. As described, when the rotation preventing ribs 28 and the rotation preventing recesses 19 are engaged, rotation of the inner container 12 relative to the outer container 11 can be prevented.

When the rotation preventing ribs 28 are inserted in the rotation preventing recesses 19, the rotation preventing ribs 28 may be in contact with a portion between two rotation preventing recesses 19. However, a large number of the rotation preventing ribs 28 are formed on the inner peripheral surface of the installing neck 18. Further, the tapered portion 19*a* is formed in a lower portion of the rotation preventing recesses 19. Therefore, the rotation preventing ribs 28 are engaged with the rotation preventing recesses 19 by slightly rotating the inner container 12.

When the inner container 12 is inserted in the outer container 11 while the rotation preventing ribs 28 are engaged with the rotation preventing recesses 19, the flange 27 is in contact with the temporarily jointing hooks 32 (specifically the protrusion inward protruding) of the temporarily jointing member 30. Then, the inner container 12 is further inserted, the temporarily jointing hooks 32 shaped like the cantilever arm are elastically deformed in the outward direction. Thus, the flange 27 climbs over the temporarily jointing hooks 32.

In a state that the flange 27 climbs over the temporarily jointing hooks 32, the upper surface of the flange 27 is in contact with the lower end portion 18*a* of the installing neck 18, and the temporarily jointing hooks 32 are jointed to the lower surface of the flange 27. When the temporarily jointing hooks 32 included in the temporarily jointing mechanism 1.3 are jointed to the flange 27, the inner container 12 is temporarily jointed to the outer container 11.

As described, when the inner container 12 is temporarily jointed to the outer container 11, the cap 22 can be removed from the inner container 12. When the cap 22 is removed, it is necessary to turn the cap 22 relative to the inner container 12. Since the inner container 12 is temporarily jointed to the outer container 11, and the rotation preventing mechanism 14 prevents the rotation of the inner container 12 relative to the outer container 11, the cap 22 can be easily removed from the inner container 12.

After the cap 22 is removed from the inner container 12, the dispenser device 90 can be installed in the double container 10A. After the cap 22 is removed, the tubular portion 25 is upwardly protruding from a ceiling 11*a* of the outer container 11. The dispenser device 90 is installed in the screw portion 26 formed in the tubular portion 25.

Figure 5:
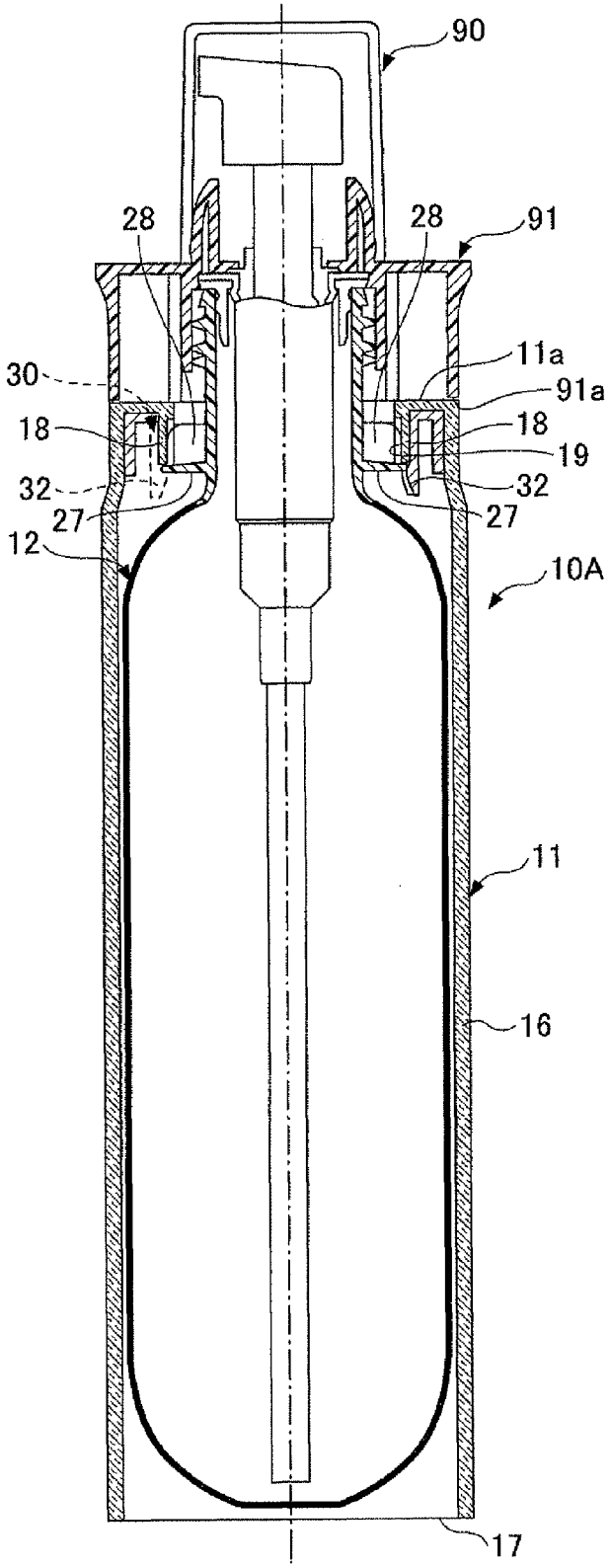
FIG. 5 is a cross-sectional view of a double container of Embodiment of the present invention provided with a dispenser device.

FIG. 5 illustrates a state in which the dispenser device 90 is screwed with the screw portion (the state is referred to as an attached state). In the attached state, a cap 91 of the dispenser device 90 presses the ceiling 11*a* of the outer container 11 with its lower end portion 91*a* due to force caused by screwing the cap with the screw portion 26. With this pressing force, the tubular portion 25 of the inner container 12 is relatively biased in the upward direction X1.

Thus, the flange 27 is stressed by a lower end portion 18*a* of the installing neck 18 because the inner container 12 is biased in the upward direction. As described, the outer container 11 is securely fixed to the inner container 12 by screwing the dispenser device 90 with the screw portion 26. Said differently, the outer container 11 and the inner container 12 are maintained to be fixed until the dispenser device 90 is removed. Under this finally fixed state, the contents supplied in the container body 23 may be discharged by the dispenser device 90.

Described next is an operation of replacing a used container 12 with a new container 12 after the contents supplied in the container body 23 are completely discharged from the used container 12.

In order to replace the inner container 12, the dispenser device 90 is first turned to remove the dispenser device 90 from the screw portion 26 of the inner container 12. Since the rotation preventing ribs 28 are being engaged with the rotation preventing recesses 19, the inner container 12 does not rotate relative to the outer container 11 in removing the dispenser device 90 from the screw portion 26.

Under a state in which the dispenser device 90 is removed, the inner container 12 is maintained to be temporarily jointed to the outer container 11 by the temporarily jointing mechanism 13. Therefore, it is possible to prevent the inner container 12 from being dropped from the outer container 11 when the dispenser device 90 is removed.

Provided that the inner container 12 is dropped, cosmetic liquid or cream remaining inside the container body 23 may possibly fly out and foul a floor. In order to prevent dropping of the inner container 12, it is necessary to support the inner container 12 by hand and turn the dispenser device 90. Therefore, operability is extremely bad. Contrary to this, since the inner container 12 is temporarily jointed to the outer container 11 in Embodiment 1, it is possible to prevent the inconvenience from occurring.

On the other hand, when the inner container 12 is removed from the outer container 11 which is temporarily jointed, the inner container may be strongly pulled in the downward direction X2. Specifically, the inner container 12 is required to be pulled downward with a force more than the jointing force between the temporarily jointing hooks 32 and the flange 27.

Then, the temporarily jointing hooks 32 of the cantilever arms, made of the material having the spring function, are elastically deformed in the outward direction to enable the flange 27 to be disengaged from the temporarily jointing hook 32. Therefore, the temporarily jointing mechanism 13 is released from the temporarily jointing state, and the inner container 12 can be removed from outer container 11. Further, when the inner container 12 is pulled from the outer container 11 in the direction X2, the rotation preventing ribs 28 are separated from the installing neck 18, and the prevention of the rotation with the rotation preventing mechanism 14 can be cancelled (released).

As described, the operation of installing the inner container 12 in the outer container 11, and the operation of separating the inner container 12 from the outer container 11 can be easily carried out in the double container 10A of Embodiment 1. Further, the inner container 12 may be temporarily jointed to the outer container 11 with ease by only inserting the installing unit 24 of the inner container 12 into the installing neck 18 of the outer container 11.

In Embodiment 1, the rotation preventing recesses 19 are formed in the outer container 11, and the rotation preventing ribs 28 are formed in the inner container 12. However, it is possible to form the rotation preventing recesses 19 in the inner container 12, and to form the rotation preventing ribs 28 in the outer container 11.

In Embodiment 1, the thickness (t) of the container body 23 is set to be 0.05 mm≤t≤0.3 mm, and the thickness (w) of the tubular portion 25 of The installing unit 24 is set to be 0.5 mm≤w≤4.0 mm. By setting the thickness (t) of the container body 23 and the thickness (w) of the tubular portion 25 as described above, it is possible to realize the inner container 12 which has the tubular portion 25 with higher rigidity and is lighter in its weight. Hereinafter, an experiment carried out by the inventor is described.

FIG. 28 illustrates the strengths and the weights of the inner container 12 when the thickness (t) of the container body 23 is changed. In the experiment, the diameters of a container body 23, the radii of curved portions in shoulder and bottom portions of the container body 23, and the capacities of the container body 23 are the same, and only the thicknesses (t) of the container body 23 are changed in a range of 0.05 mm≤t≤0.3 mm. The strengths and the weights of the container body 23 are measured with respect to the range of 0.05 mm≤t≤0.3 mm.

The strength is determined whether the container body 23 is broken after filling the inner container 12 with contents and dropping the inner container 12 from a predetermined height. When the inner container 12 is broken, it is marked "x". When the inner container 12 is not broken, it is marked "○" (a circle). When the inner container 12 is neither broken nor deformed, it is marked "◎" (two concentric circles). The weight is determined based on an average weight of ordinary inner containers having the same capacity used for conventional double containers. When the weight is substantially the same, it is marked "X"(a cross X). When the weight is less, it is marked "○" (a circle). When the weight is extremely less, it is marked "◎"(two concentric circles).

Referring to FIG. 28, it is known that the weight becomes less but the strength is not sufficient when the thickness t of the container body 23 is smaller than 0.05 mm. When the thickness t of the container body 23 is larger than 0.3 mm, the weight is not reduced but the strength is sufficient. Therefore, it is experimentally proved from the experimental results illustrated in FIG. 28 that an inner container having both sufficient strength and less weight can be realized by setting the thickness (t) of the container body to be 0.05 mm≤t≤0.3 mm.

FIG. 29 illustrates the weights of the inner containers and the rigidities of the tubular portions 25 when the thickness (w) of the tubular portion 25 is changed in a range of 0.5 mm≤t≤4.0 mm The experimental conditions are the same as those in the experiment illustrated in FIG. 28. The rigidities are determined when a dispenser device 90 is installed in the neck portion of various inner containers. When operability in installing the dispenser device 90 is bad because the rigidity is low, it is marked "X" (a cross X). When the dispenser device 90 can be installed, it is marked "○"(a circle). When the dispenser device 90 can be installed very well, it is marked "◎" (two concentric circles). The weight is determined in the same way as the experiment illustrated in FIG. 28.

When the thickness (w) of the tubular portion 25 is less than 0.5 mm, the weight can be reduced, but the rigidity is insufficient to thereby degrade the operability in installing the dispenser device 90. When the thickness w of the container body 23 is larger than 4.0 mm, the weight is not reduced but the strength is sufficient. Therefore, it is experimentally proved from the experimental results that an inner container having both sufficient strength and less weight can be realized by setting the thickness w of the tubular portion 25, to which the cap and the dispenser device 90 are attached while being inserted in the outer body, to 0.5 mm≤t≤4.0 mm.

Figure 13A:
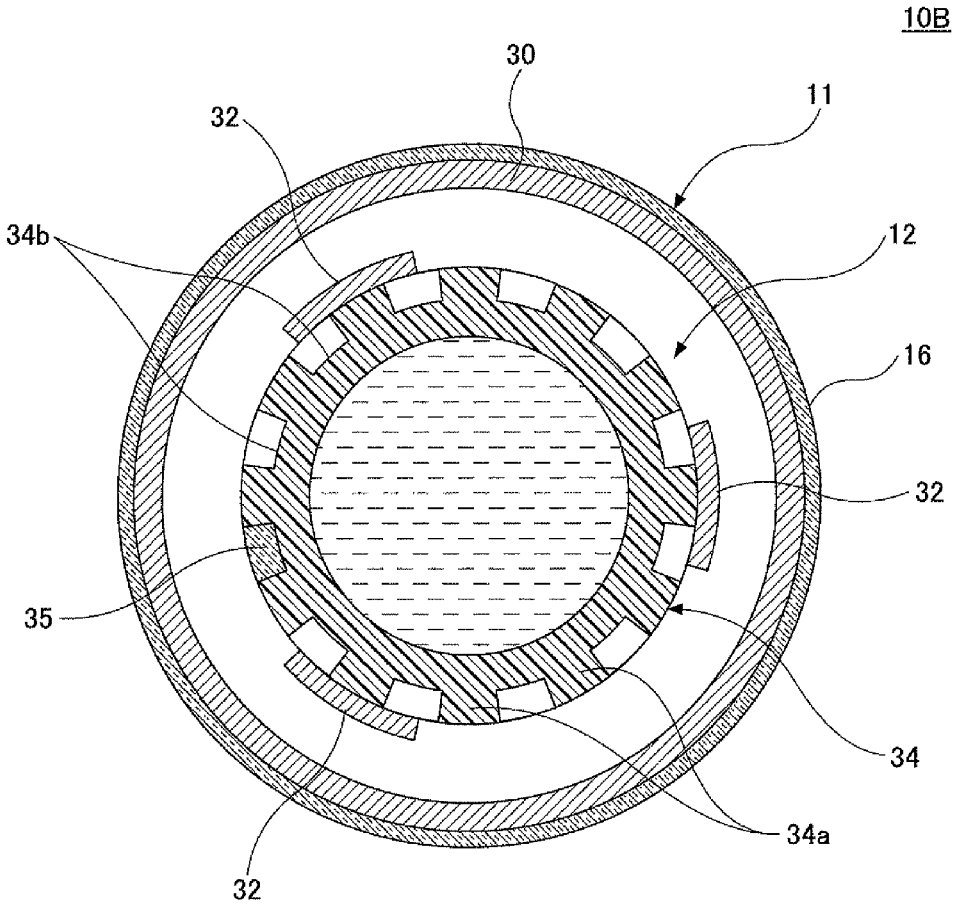
FIG. 13A is a lateral cross-sectional view of a double container of a modified example of Embodiment 1 of the present invention.
Figure 13B:
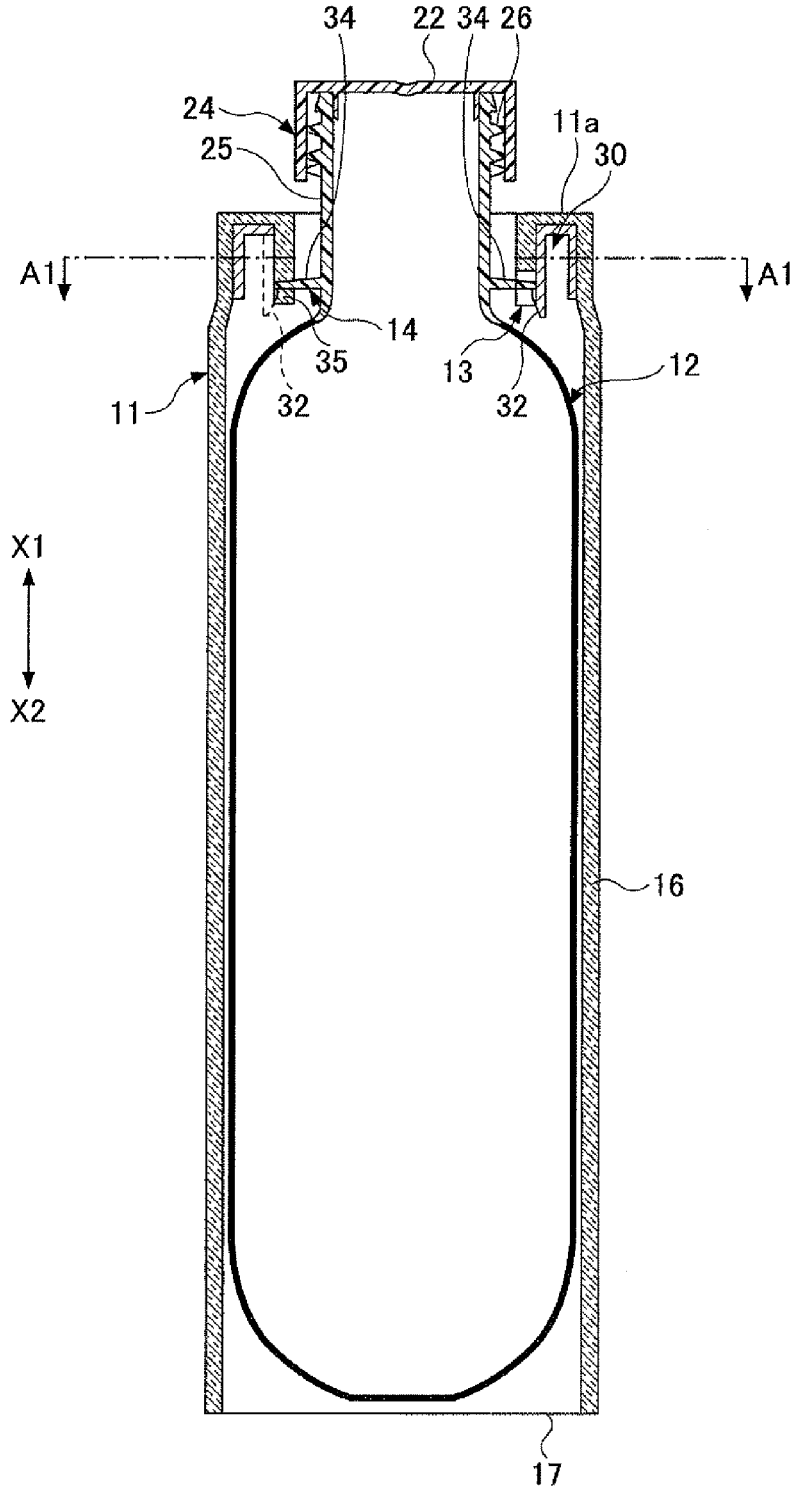
FIG. 13B is a longitudinal cross-sectional view of the double container of the modified example of Embodiment 1 of the present invention.

Next, a modified example of the double container 10A of Embodiment 1 is described. FIG. 13A and FIG. 13B illustrate a double container 10B which is the modified example of the double container 10A of Embodiment 1. In the double container 10B, a cogged flange 34 having functions similar to the rotation preventing recesses 19 is formed in an inner container 12, and rotation preventing ribs 35 are formed in an outer container 11.

A rotation preventing mechanism 14 of the modified example includes the rotation preventing ribs 35 formed on an installing neck 18(see FIG. 1) of the outer container 11, and the cogged flange 34 formed on the tubular portion 25 of the inner container 12.

The cogged flange 34 extends outward from the tubular portion 25. The cogged flange 34 has plural protrusions 34*a* extending outward at predetermined pitches. Therefore, the cogged flange 34 has the protrusions 34*a* and recesses 34*b* relatively appearing between the protrusions 34*a*.

The number of the rotation preventing ribs 35 is one in this modified example. The rotation preventing rib 35 is engaged with the recesses 34*b* of the cogged flange 34. As described, when the rotation preventing rib 35 is engaged with the cogged flange 34, rotation between the outer container 11 and the inner container 12 is stopped.

A temporarily jointing mechanism 13 of the modified example is the same as that in the double container 10A of Embodiment 1. Specifically, hooks 32 are jointed to the protrusions 34*a* of the cogged flange 34 to thereby temporarily joint the inner container 12 to the outer container 11.

Although in Embodiment 1 and the modified example, the outer container 11 and a temporarily jointing member 30 are separated, it is possible to integrally form the outer container 11 and the temporarily jointing member 30.

Embodiment 2 of the present invention is described.

FIG. 6 thru FIG. 11 illustrate a double container 40 of Embodiment 2 of the present invention. Referring to FIG. 6 to FIG. 11, the same reference symbols are attached to structural elements corresponding to the structural elements of the double container 10A and 10B of Embodiment 1 illustrated in FIG. 1 to FIG. 5 and descriptions of these structural elements are omitted. Referring to the figures used in the following Embodiments, an inner container 42 has a cavity. For convenience, the entire cavity in a cross-sectional view of the inner container 42 is indicated by hatching.

The double container 40 of Embodiment 2 includes an outer container 41, the inner container 42, a temporarily jointing and rotation preventing mechanism 43A and so on. With Embodiment 2, a cosmetic container is exemplified as the double container 40. In FIG. 6 to FIG. 11, an arrow X1 designates an upward direction, and an arrow X2 designates a downward direction.

Figure 6:
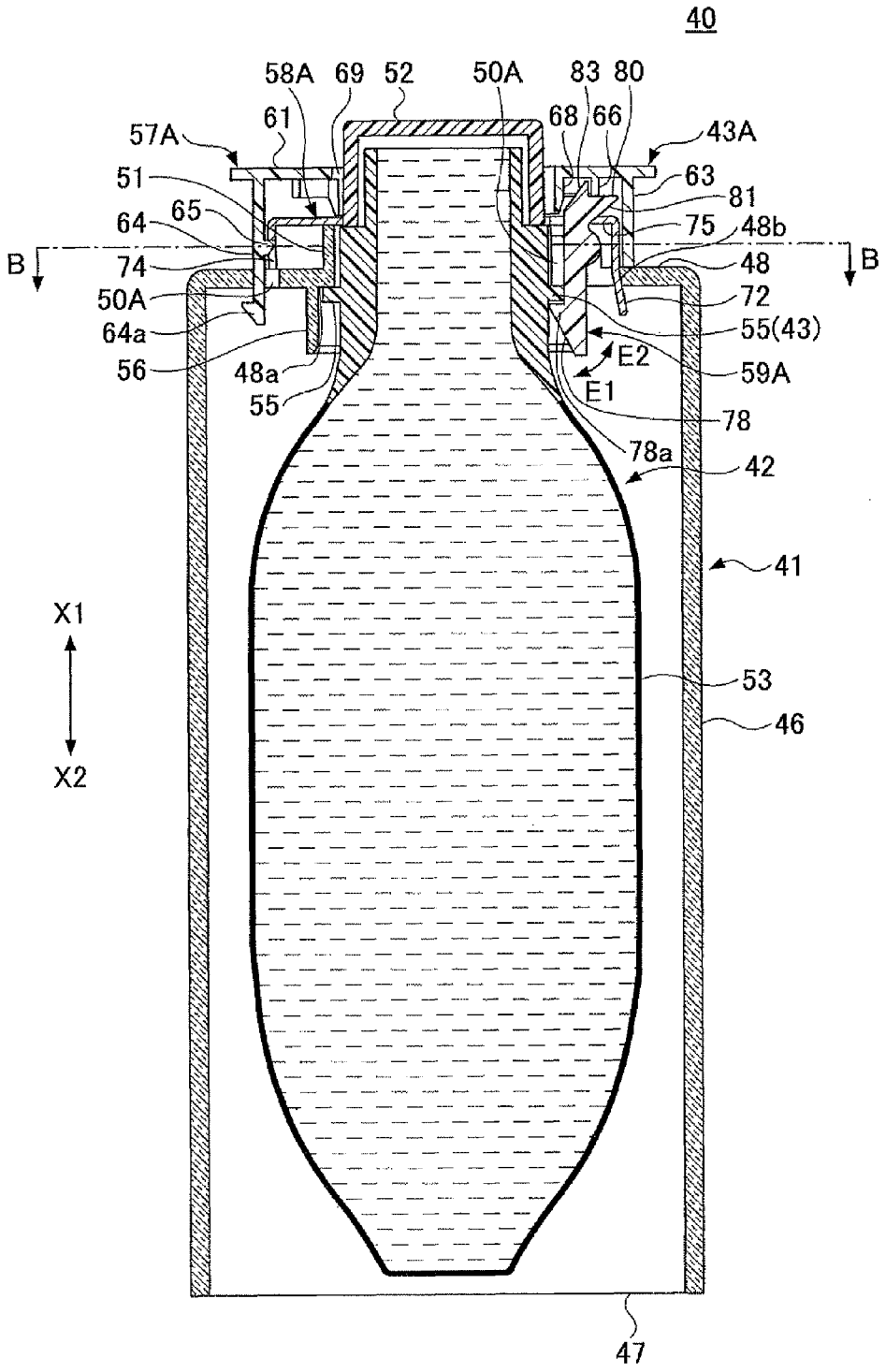
FIG. 6 is a cross-sectional view of a double container of Embodiment 2 of the present invention.
Figure 7:
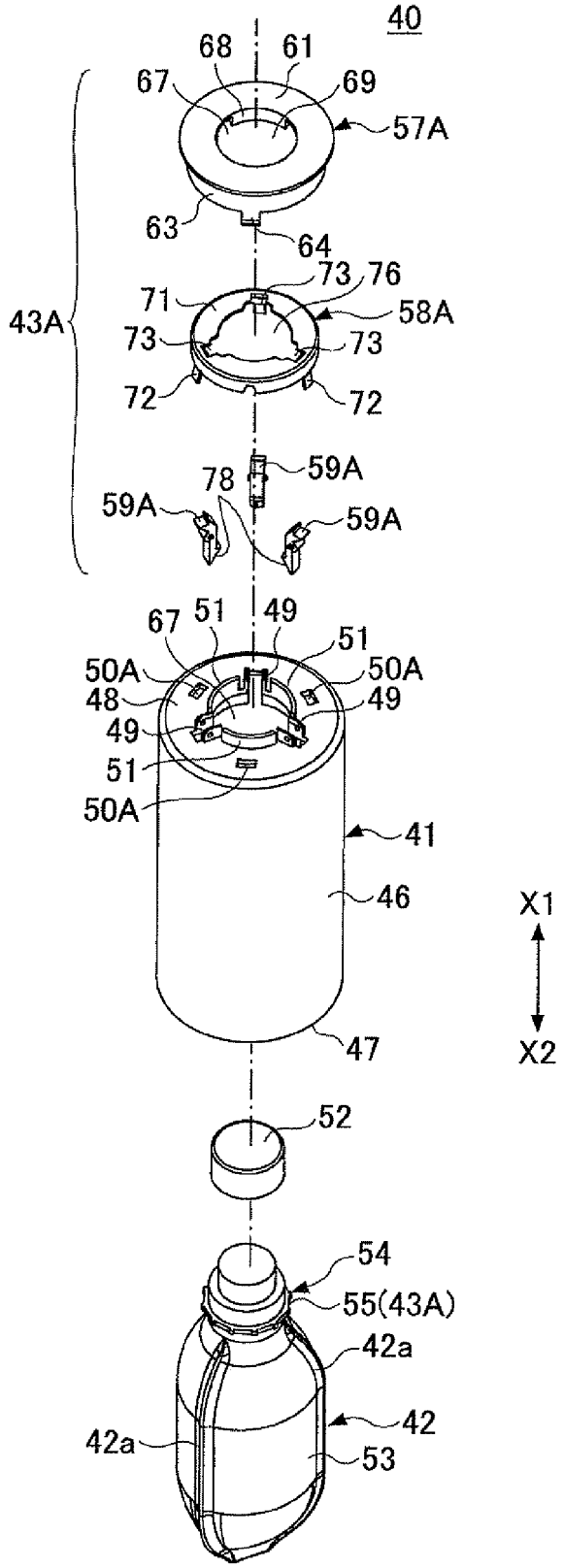
FIG. 7 is a cross-sectional view of a double container of Embodiment 2 of the present invention.

For example, the outer container 41 has a substantially cylindrical shape and is molded resin. However, other materials such as glass or ceramic may be used for the outer container 41 as in Embodiment 1. Referring to FIG. 6 and FIG. 7, the outer container 41 includes a cylindrical body 46, a bottom opening 47, a ceiling 48, bearing portions 49, penetrating apertures 50A, and standing portions 51.

The cylindrical body 46 is shaped like a cylinder, and the bottom opening 47 is formed on the lower end of the cylindrical body 46. The inner container 42 is inserted into the cylindrical body 46 from the bottom opening 47. The outer container 41 different from the inner container 42 functions as a refill container and is used for a long time without being disposed of. The ceiling 48 is formed in an upper end portion of the cylindrical body 46. An opening 67 is formed in a center portion of the ceiling 48. In an edge of the opening 67, the bearing portions 49 and the standing portion 51 are formed. The bearing portions 49 support hook members 59A described later. With Embodiment 2, three bearing portions 49 are arranged with intervals of 120°.

The standing portions 51 protrude upward from the ceiling 48. The standing portions 51 are formed between the bearing portions 49. Further, on the outside of the standing portions 51 of the ceiling 48, the plural penetrating apertures 50A are formed. The penetrating apertures 50A are formed to correspond to lever portions 72 formed in a spring 58A to be described below.

On a back side of the ceiling 48, a hanging portion 56 downwardly extends and is formed on a back side of the ceiling 48. The hanging portion 56 is provided except for the positions of forming the bearing portions 49. The inner diameter of the hanging portion 56 is set to be relatively larger than the inner diameter of the standing portion 51. Therefore, a step is formed on the back face side of the standing portion 51 of the ceiling 48. Hereinafter, a face forming the step inside the hanging portion 56 on the back side of the ceiling 48 is referred to as a contact face 48*a*.

The inner container 42 is a refill container which is exchanged after the contents are completely ejected. The inner container 42 includes a container body 53 and an installing unit 54. The container body 53 is shaped like a tube and contents (cosmetic product in Embodiment 2) are supplied inside the container body 53. With Embodiment 2, plural bosses 42*a* are formed in the container body 53 to prevent deformation from randomly occurring in the container body in ejecting the contents.

The installing unit 54 is integrally formed with the container body 53 in its upper portion. The installing unit 54 includes a screw portion 26 (not illustrated) and a cogged flange 55. The screw portion 26 and a cap 52 are screwed together. The screw portion 26 and the dispenser device 90 (see FIG. 5) are screwed together when the double container is finally used.

Figure 11:
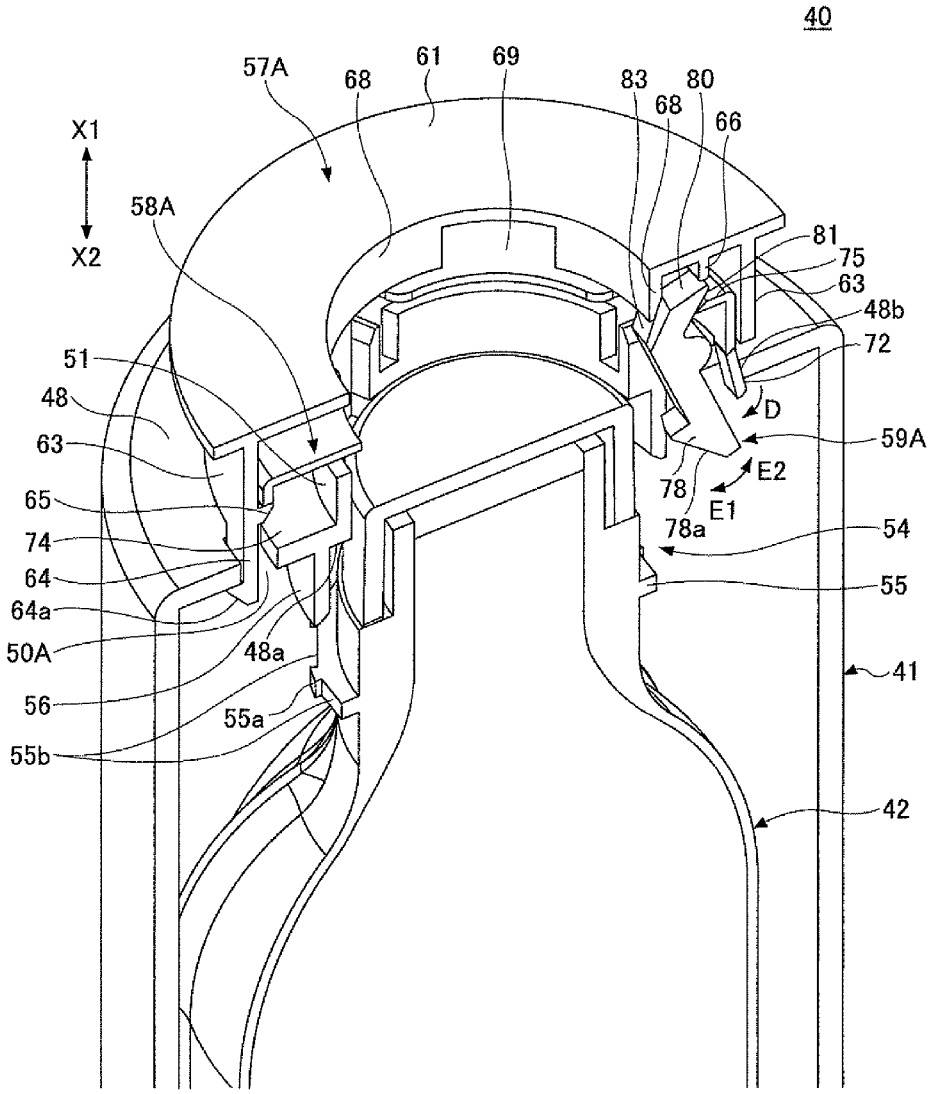
FIG. 11 is a cross-sectional perspective view of the double container of Embodiment 2 where the inner container is released from the temporary mounting on the outer container.

The cogged flange 55 extends outward from the installing unit 54 as illustrated in an enlarged view of FIG. 11. The cogged flange 55 has plural protrusions 55*a* outwardly extending at predetermined pitches.

Therefore, the outer peripheral portion of the cogged flange 55 has the protrusions 55*a* and recesses 55*b* relatively appearing between the protrusions 55*a*. Further, the diameter of the cogged flange 55 is set to be in contact with the contact face 48*a* when the inner container 42 is inserted into the outer container 41.

The temporarily jointing and rotation preventing mechanism 43A includes the cogged flange 55, an operating cap 57A, the spring 58A, and the hook members 59A. The temporarily jointing and rotation preventing mechanism 43A is equivalent to a structure of integrating a temporarily jointing mechanism 13 with a rotation preventing mechanism 14.

Therefore, when the inner container 42 is installed in the outer container 41, the inner container 42 is temporarily jointed to the outer container 41 by the temporarily jointing and rotation preventing mechanism 43A to thereby prevent rotation of the inner container 42 relative to the outer container 41. Hereinafter, the structure of the temporarily jointing and rotation preventing mechanism 43A is described.

As enlarged by FIG. 11, the operating cap 57A includes an annular portion 61, a cylindrical portion 63, hook portions 64, engaging nails 65, a pushing piece 66, a contact piece 68, an opening 69, and so on. The annular portion 61 is shaped like a ring. The annular portion 61 is held and operated when the double container is handled.

In the center of the annular portion 61, the opening 69 is formed. The diameter of the opening 69 is set larger than the diameter of the installing portion 54 to which the cap 52 is attached. In a similar manner thereto, the diameter of the opening 67 formed in the outer container 41 is set larger than the diameter of the installing unit 54 to which the cap 52 is attached.

The cylindrical portion 63 is provided to extend downward on the back side of the annular portion 61. The operating cap 57A is biased downward in a direction of X2 by spring force of the spring 58A. However, when the annular portion 61 is in contact with the ceiling 48 of the outer container 41, the operation cap 57A is prevented from being moved downward.

Plural engaging nails 65 are formed on an inner peripheral surface of the cylindrical portion 63. The engaging nails 65 are engaged with edges of engaging holes 74 formed in the spring 58A. Therefore, when the operating cap 57A is moved upward by an operator, the spring 58A engaged with the engaging nails 65 is also moved upward.

The hook portions 64 further extends downward in the direction X2 to be lower than the lower portion of the cylindrical portion 63. Hooks 64*a* are formed in tip ends of the hook portions 64. The hook portions 64 are inserted into the penetrating apertures 50A formed in the ceiling 48 of the outer container 41.

As described, since the outwardly protruding hooks 64*a* are formed in lower ends of the hook portions 64, by inserting the hook portions into the penetrating apertures 50A, the hooks 64*a* are engaged with the back surface of the ceiling 48. With this, the operating cap 57A is prevented from being separated from the outer container 41. However, the operating cap 57A is upward and downward movable relative to the outer container 41 by a length of the hook portions 64 in the X1 and X2 directions.

The pushing piece 66 and the contact piece 68 are positioned facing the bearing portion 49 on the back side of the annular portion 61. The pushing piece 66 and the contact piece 68 are described later when the hook member 59A is described later for convenience of the explanation.

Next, the spring 58A is described.

The spring 58A may be made of a flexible material. The spring 58A includes a ceiling 71, lever portions 72, recesses 73, and engaging openings 74. The ceiling 71 is in an annular shape and has an opening 76 in a center thereof. The diameter of the opening 76 is set to be larger than the diameter of the installing portion 54 to which the cap 52 is attached.

The spring 58A is installed inside the operating cap 57A as illustrated in FIG. 6 and FIG. 11. Therefore, the outer periphery (diameter) of the ceiling 71 is small enough to pass through the inner periphery (diameter) of the cylindrical portion 63 of the operating cap 57A.

The lever portions 72 extend downward from the ceiling 71. The lever portions 72 are inserted into the respective bearing portions 49 formed in the outer container 41 so as to be in contact with respective edges 48*b* of the ceiling 48 (illustrated in FIG. 10 and FIG. 11). The lever portions 72 are bent in directions from the center to the outer periphery of the ceiling 48 from the roots of the lever portions 72 to the tip ends of the lever portions 72.

Further, the lever portions 72 outwardly bias the respective edges 48*b* of the ceiling 48 where the spring 58A is installed in the outer container 41. Therefore, the spring force is applied to the spring 58A to constantly move the spring 58A in the downward direction X2 toward the ceiling 48.

Figure 9:
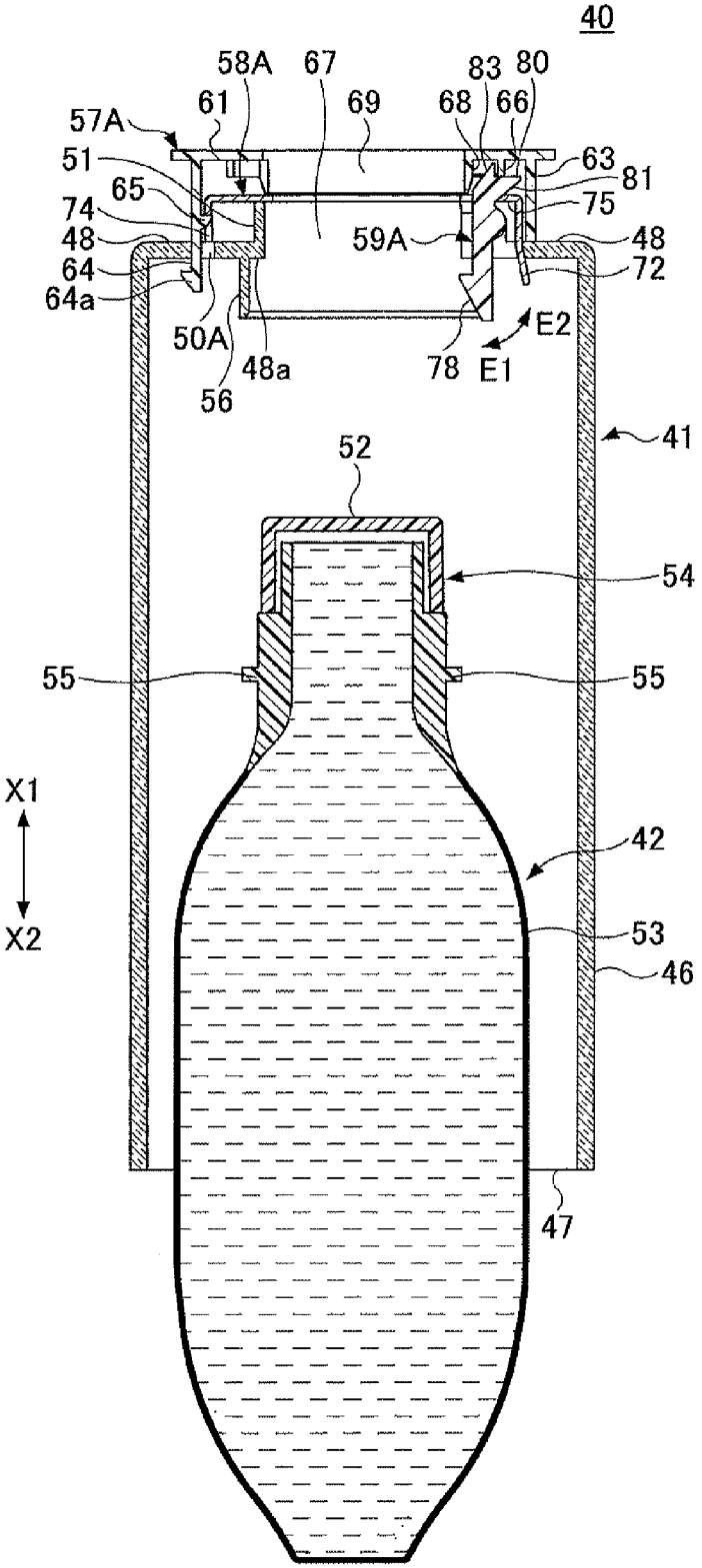
FIG. 9 is a cross-sectional view of the double container of Embodiment 2 where the inner container is temporarily mounted on the outer container.
Figure 10:
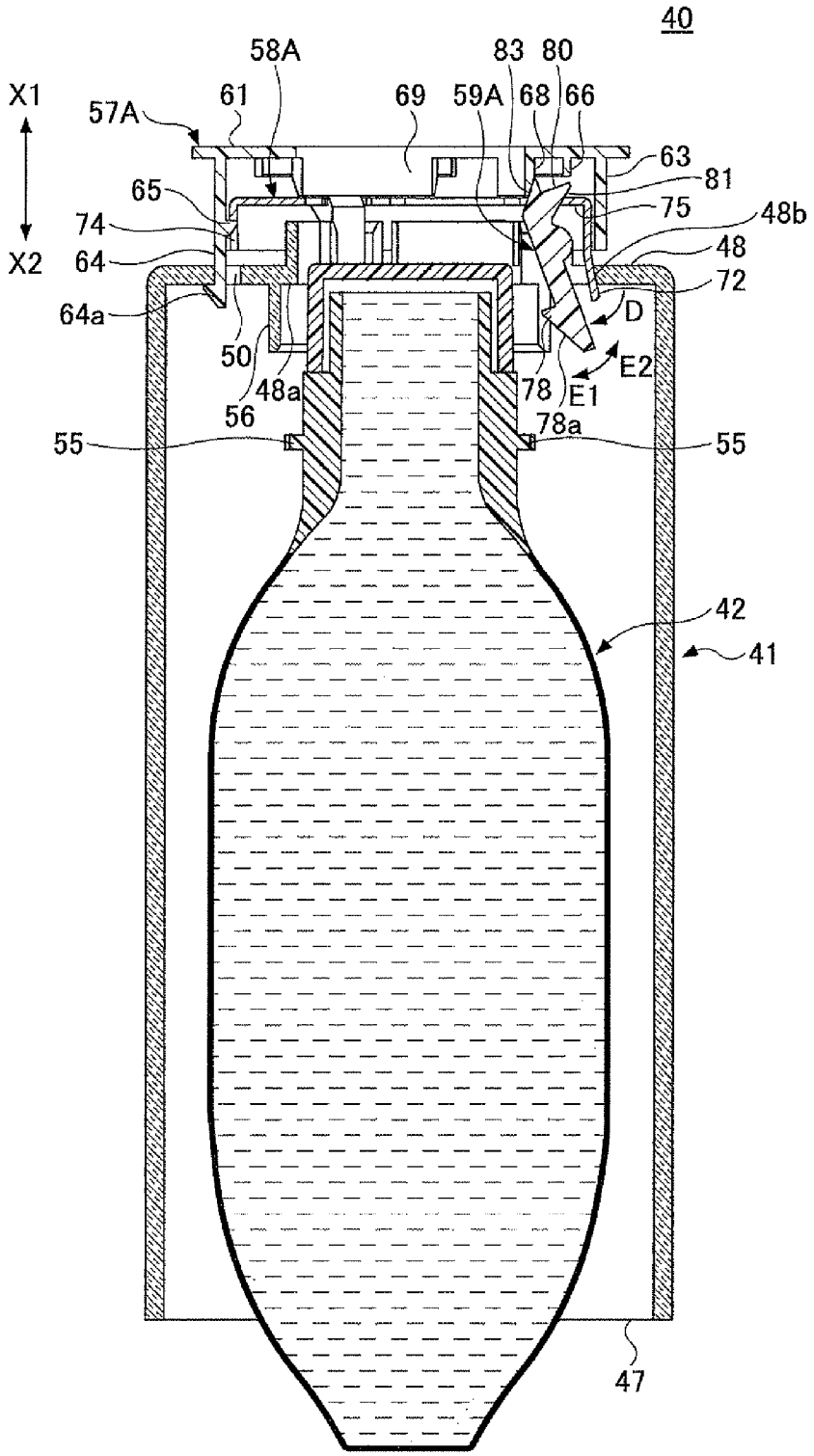
FIG. 10 is a cross-sectional view of the double container of Embodiment 2 where the inner container is released from the temporary mounting on the outer container.

The recesses 73 are formed in the ceiling 71 so as to correspond to the positions of the bearing portions 49. The bearing portions 49 are arranged inside the recesses 73. Referring to FIG. 6 and FIG. 9, the engaging openings 74 are formed on a side surface of the spring 58A and are engaged with the engaging nails 65 formed in the operating cap 57A as described above.

Next, the hook members 59A are described.

Figure 12:
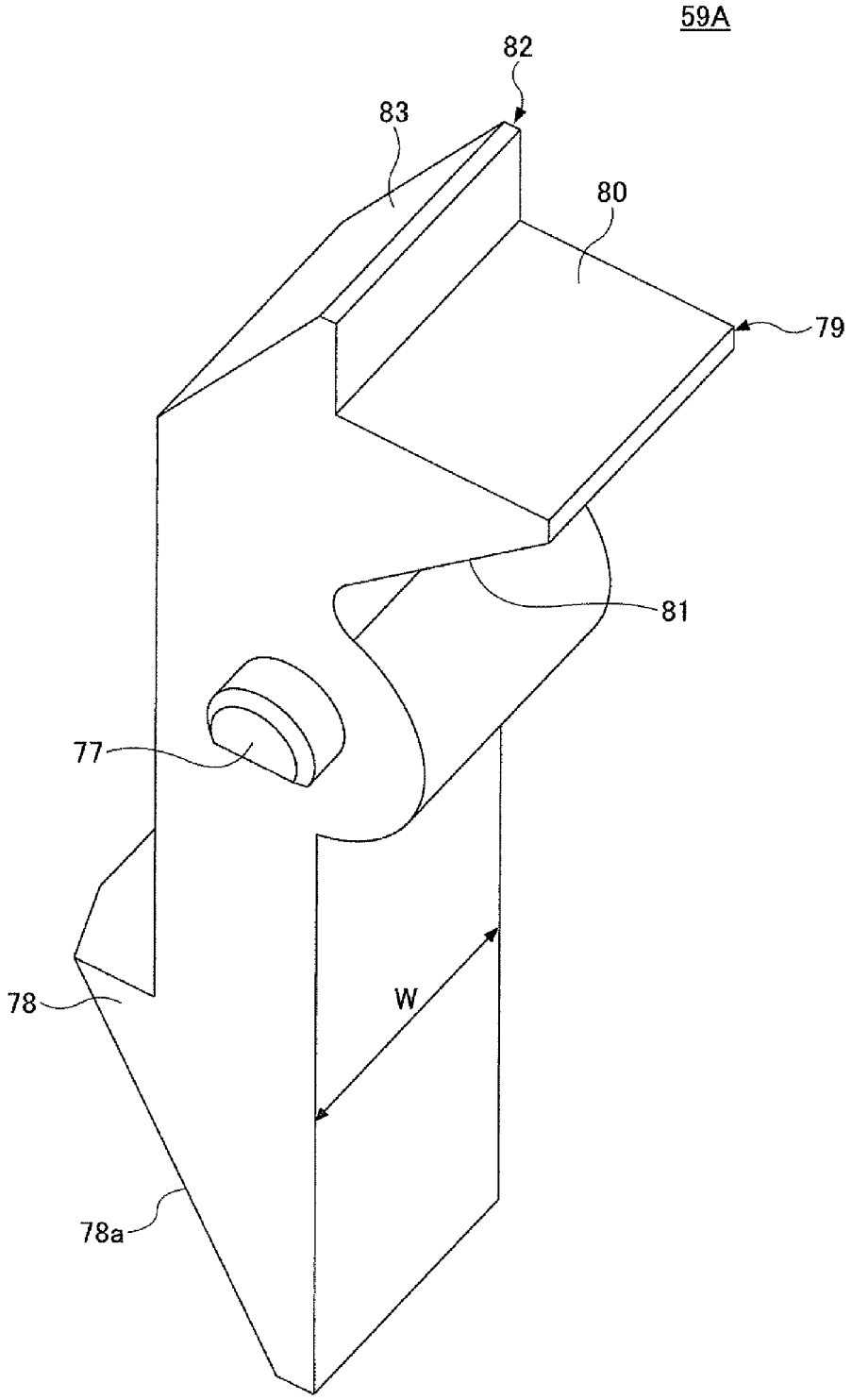
FIG. 12 is an enlarged perspective view of a hook member used for the double container of the Embodiment 2 of the present invention.

FIG. 12 is an enlarged view of the hook member 59A. The hook member 59A is molded of resin and integrally includes a rotary shaft 77, a hook 78, a first shear 79, and a second shear 82.

Figure 8:
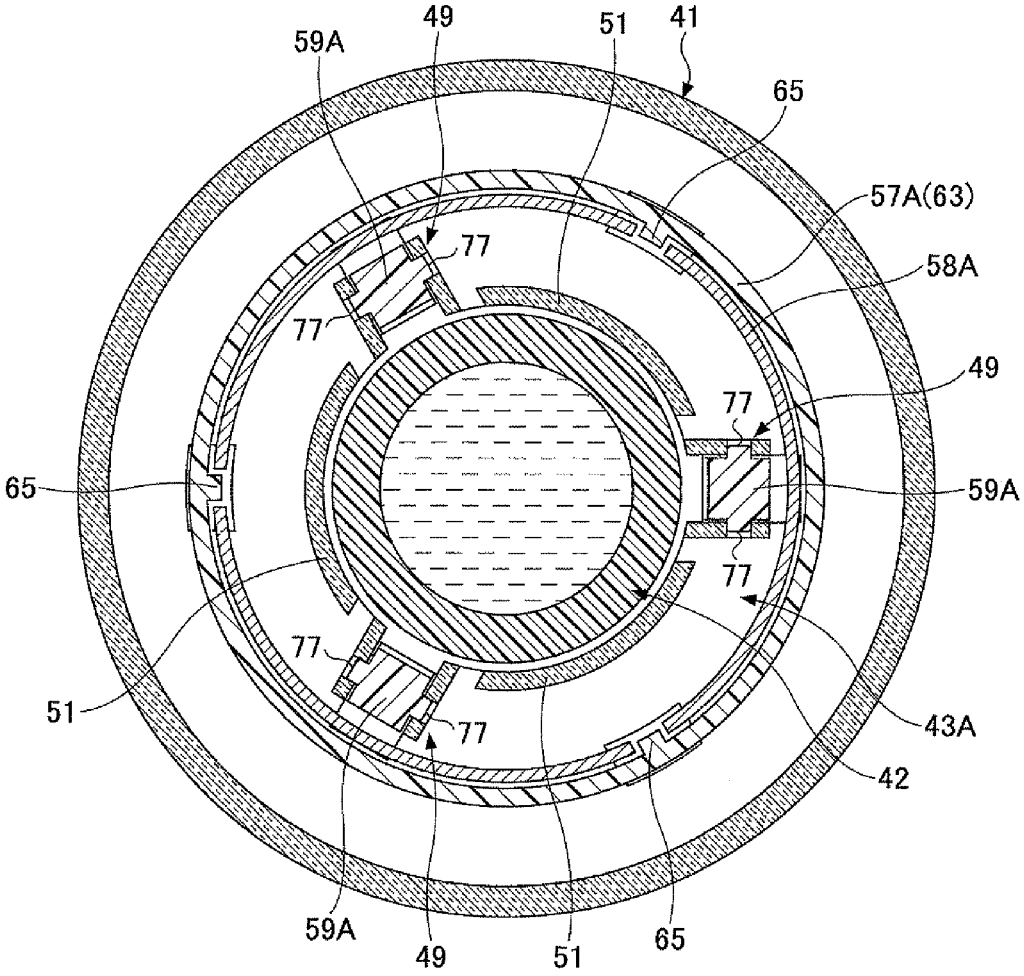
FIG. 8 is a cross-sectional view taken along a line B-B of FIG. 5.

The rotary shaft 77 is supported by the bearing portion 49 provided in the outer container 41. With this, the hook members 59A become rotatable relative to the bearing portions 49. FIG. 8 illustrates the rotary shafts 77 supported by the bearing portions 49.

Although the rotary shaft 77 and the other portions of the hook member 59A are integrally molded in Embodiment 2, the rotary shaft 77 may be made of metal and fixed to the hook member 59A. With Embodiment 2, since the bearing portion 49 can be integrally formed with the other portions of the hook member 59A, it is possible to reduce the number of parts and make assembly be advantageous in comparison with a structure in which the rotary shaft 77 is a separate part.

The hook 78 is formed to be positioned on the side of the opening 67 where the hook member 59A is provided in the bearing portion 49. The hooks 78 are engaged with the cogged flange 55 of the inner container 42 when the inner container 42 is installed in the outer container 41 as described later.

The first shear 79 is a triangular protrusion in its cross-section and has a first face 80 and a second face 81. The second shear 82 is also a triangular protrusion in its cross-section and has a contact face 83.

Referring to FIG. 6 and FIG. 11, when the hook members 59A are installed in the bearing portions (hereinafter, referred to as a hook installing state),the first face 80 of the first shear 79 is positioned to face the pushing piece 66 which is formed downward from the back face of the annular portion 61 of the operating cap 57A.

Under the hook installing state, the second face 81 of the first shear 79 is positioned to face the edge 75 of the spring 58A. Further, the contact face 83 of the second shear 82 is formed to face the contact piece 68 which extends downward from the back face of the annular portion 61 of the operating cap 57A.

Therefore, when the operating cap 57A moves downward, the pushing piece 66 also moves downward to thereby push the first face 80. Since the first face 80 is positioned at an upper portion of the rotary shaft 77 which is a rotational center of the hook member 59A, when the first face 80 is pushed by the pushing piece 66, the hook 78 of the hook member 59A is inwardly moved in the direction indicated by an arrow E1 in FIG. 6.

However, the downward movement of the operating cap 57A is restricted by a contact of the ceiling 48 of the outer container 41 with the cylindrical portion 63 of the operating cap 57A. Therefore, after the cylindrical portion 63 is in contact with the ceiling 48, the hook member 59A is prevented from moving further in the direction of E1. In the following explanation, the cylindrical portion 63 is in contact with the ceiling 48 in a temporarily jointing state.

On the other hand, the second faces 81 of the hook members 59A face the edges 75 of the springs 58A. Therefore, if the spring 58A moves upward in the direction of X1, the engaging openings 74 moves upward while pushing the second faces 81 of the hook members 59A. Referring to FIG. 6, the second faces 81 extend obliquely upward in the temporarily jointing state. Therefore, the edges 75 of the springs 58A push the second surface extending obliquely upward in the upward direction X1 to thereby move the hook members 59A outward in the direction E2 in FIG. 6.

However, the more the hook member 59A moves in the direction E2, the closer to the contact piece 68 the contact face 83 of the second shear 82 comes. When the contact face 83 is in contact with the contact piece 68, the hook member 59A is prevented from moving more. Therefore, after the contact face 83 of the hook member 59A is in contact with the contact piece 68 of the operating cap 57A, the hook member 59A is prevented from moving further in the direction of E2. In the above description, the contact face 83 is in contact with the contact piece 68*a* in a temporary joint releasing state.

Subsequently, an operation of installing the inner container 42 in the outer container 41 and an operation of separating the inner container 42 from the outer container 41 in the double container 40 are described.

FIG. 9 illustrates a state immediately before the inner container 42 is temporarily jointed to the outer container 41. With Embodiment 2, if the inner container 42 is not installed in the outer container 41, the temporarily jointing and rotation preventing mechanism 43A is set to be in the temporarily jointed state. Under this temporarily jointing state, the spring 58A is downwardly biased.

When the engaging nails 65 are engaged with the engaging openings 74 of the spring 58A, the operating cap 57A is downwardly biased thereby causing the pushing piece 66 to push the first face 80 of the hook members 59A downward. With this, the hooks 78 of the hook members 59A extend in upward and downward directions parallel to the directions X1 and X2 as illustrated in FIG. 9. Under the temporarily jointing state, the hooks 78 of the hook members 59A protrude inside the opening 67.

In order to install the inner container 42 in the outer container 41, the inner container 42 is inserted into the cylindrical body 46 of the outer container 41 from the bottom opening 47. The cap 52 and the screw portion 26 of the inner container 42 are screwed together to prevent the contents of the container body 53 from leaking outward while inserting the inner container 42 in the outer container 41.

The outer periphery (diameter) of the cap 52 is smaller than the inner peripheries (diameters) of the openings 67, 69 and 76 of the outer container 41, the operating cap 57A, and the spring 58A. The tubular portion 25 of the inner container 42 and the cap 52 can be inserted in the openings 67, 69 and 76. Therefore, by inserting the inner container 42 in the outer container 41, the cap 52 is inserted in the openings 67, 69 and 76.

Under the temporary jointing state, the hook members 59A are displaced in the direction E1. The hooks 78 protrude inside the opening 67. However, because the cap 52 and the installing unit 54 are inserted in the openings 67, 69 and 76, the sizes of the cap 52 and the installing unit 54 are small enough to prevent engagement with the hook members 59A.

In contrast, the size of the cogged flange 55 formed below the installing unit 54 of the inner container 42 is large enough to be engaged with the hooks 78. Therefore, when the inner container 42 is inserted in the outer container 41, the cogged flange 55 is in contact with the hooks 78 of the hook members 59A. As illustrated in the figures, the hooks 78 have corresponding oblique faces. Therefore, the further the inner container 42 advances in the direction X1, the more the cogged flange 55 pushes the oblique faces. Then, the hook members 59A are moved in the direction E2 while withstanding the bias force of the operating cap 57A.

When the cogged flange 55 climbs over the hooks 78, the hook members 59A are displaced back in the direction E1 with restoring force, and the hooks 78 are engaged with the cogged flange 55 to be in the temporary jointing state. Under this temporarily jointed state, the upper surface of the cogged flange 55 is in contact with the contact face 48*a* of the outer container 41, and the lower surface of the cogged flange 55 is engaged with the hooks 78. Therefore, the inner container 42 is temporarily jointed to the outer container 41 firmly without gaps. FIG. 6 illustrates a state in which the inner container 42 is temporarily jointed to the outer container 41.

At this time, the widths W of the hooks 78 illustrated in FIG. 12 are smaller than pitches of cogs 55*a* formed in the cogged flange 55*a*. Therefore, the hook members 59A are positioned between slots 55*b*. Therefore, if the inner container 42 is forced to rotate relative to the outer container 41, sides of the hook members 59A are in contact with the cogs 55*a* to thereby prevent the hook members 59A from rotating.

Under the temporarily jointed state, step portions of the hooks 78 are engaged with the lower surface of the cogged flange 55 to secure the inner container 42. Therefore, if the inner container 42 is biased in the downward direction X2 from the outer container 41, since the hooks 78 secure the cogged flange 55, the inner container does not separate from the outer container 41.

Especially, the hooks 78 of the hook members 59A are biased toward the cogged flange 55 by the spring force of the spring 58A in Embodiment 2. Therefore, it is possible to securely prevent the inner container 42 from separating from the outer container 41 to thereby enhance reliability of the temporary joint.

When the hooks 78 are engaged with the cogged flange 55, the hooks 78 may be in contact with the cogs 55*a*. However, the number of the cogs 55*a* is many and the sizes of the cogs 55*a* are set to be small enough to prevent the inner container 42 from rotating. Therefore, by slightly rotating the inner container 42, the hooks 78 may be positioned inside the slots 55*b*.

As described, when the inner container 42 is temporarily jointed to the outer container 41, the cap 52 can be removed from the inner container 42 in a similar manner to that in Embodiment 2. When the cap 52 is removed, the cap 52 is rotated relative to the inner container 42. The inner container 42 is temporarily jointed to the outer container 41 by the temporarily jointing and rotation preventing mechanism 43A to thereby prevent the inner container from rotating relative to the outer container 41. Therefore, the cap 52 can be easily removed from the inner container 42 in the double container 40 of Embodiment 2.

After the cap 52 is removed from the inner container 42, the dispenser device 90 can be installed in the double container 40. With this, the inner container 42 is fixed to the outer container 41. Under this finally fixed state, the content supplied in the container body 53 may be discharged by the dispenser device 90.

Next, an operation of replacing the used inner container 42 with a new inner container 42 in the double container 40 of Embodiment 2 is described.

In order to replace the inner container 42, the dispenser device 90 is first removed from the installing unit 54 of the inner container 42. Since the inner container 42 is prevented from rotating relative to the outer container 41 by the temporarily jointing and rotation preventing mechanism 43A, it is possible to remove the dispenser with good operability.

Under a state in which the dispenser device 90 is removed, the inner container 42 is maintained to be temporarily jointed to the outer container 41 by the temporarily jointing mechanism 43. Therefore, it is possible to prevent the inner container 42 from being dropped from the outer container 41 when the dispenser device 90 is removed.

On the other hand, when the inner container 42 in the temporarily jointed state is removed from the outer container 41, the operating cap 57A is grasped and moved in a direction of departing from the operating part from the outer container 41 in the upper direction X1 By pulling up the operating cap 57A, the spring 58A engaged with the operating cap 57A via the engaging nails 65 is moved upward.

As described, the edges 75 of the spring 58A face the second faces 81 of the hook members 59A. The edges 75 push the second face 81 with the upward movement of the springs 58A to thereby rotate the hook member 59A in the direction of the arrow E2. With this, the hooks 78 are separated from the cogged flange 55 to be released from the temporary joint and from the prevention of the rotation. Therefore, the temporary joint with the temporarily jointing and rotation preventing mechanism 43A is released, and the inner container 42 can be removed from outer container 41.

When the operating cap 57A is moved upward by a predetermined amount of releasing the temporary joint, the contact face 83 is in contact with the contact piece 68 and the hooks 64*a* provided in the hook portions 64 are in contact with the back surface of the ceiling 48. With this, the upward movement of the operating cap 57A is prevented to thereby prevent the operating cap 57A from separating from the outer container 41.

When the temporary joint is released, the operator stops to touch the operating cap 57A. As described, when the spring 58A is moved upward, the lever portions 72 are biased in the direction of the arrow D by the edges 48*b* to cause the spring force to occur. When the operator stops to touch the operating cap 57A, the spring 58A is downward biased by the caused spring force.

When the spring 58A moves downward, the operating cap 57A moves downward along with the downward movement. When the lower end portion of the cylindrical portion 63 is in contact with the ceiling 48, the temporarily jointing and rotation preventing mechanism 43A returns to the temporarily jointed state.

As described, the operation of installing the inner container 42 in the outer container 41, and the operation of separating the inner container 42 from the outer container 41 can be easily carried out in the double container 40 of Embodiment 2. Further, the inner container 42 may be temporarily jointed to the outer container 41 with ease by only inserting the installing unit 54 of the inner container 42 into the installing neck 18 (see FIG. 1) of the outer container 41. In order to eject the inner container 42 from the outer container 41, it is sufficient to pull the operating cap 57A. Therefore, the ejecting process of the inner container 42 becomes easy.

The temporary joint is released by moving the operating cap 57A in the direction of departing from the outer container 41, it is also possible to release the temporarily jointed state by moving the operating cap in a direction of approaching the outer container 41.

Embodiment 3 of the present invention is described.

FIG. 14 thru FIG. 20 illustrate a double container 90 of Embodiment 3 of the present invention. Referring to FIG. 14 to FIG. 20, the same reference symbols are attached to structural elements corresponding to the structural elements of the double container 10A, 10B and 40 of Embodiment 1 and Embodiment 2 illustrated in FIG. 1 to FIG. 13 and descriptions of these structural elements are omitted.

The double container 90 of Embodiment 3 includes an outer container 41, an inner container 42, a temporarily jointing and rotation preventing mechanism 43B and so on. With Embodiment 3, a cosmetic container is exemplified as the double container 90.

According to the double container 40 of Embodiment 2, the temporarily jointing and rotation preventing mechanism 43A provided in the double container 40 is structured to move the operating cap 57A in the direction X1 of separating from the outer container 41. According to the double container 90 of Embodiment 3, the temporarily jointing and rotation preventing mechanism 43B provided in the double container 90 is structured to separate the inner container 42 from the outer container 41 by rotating an operating cap 570 relative to the outer container 41.

Figure 14:
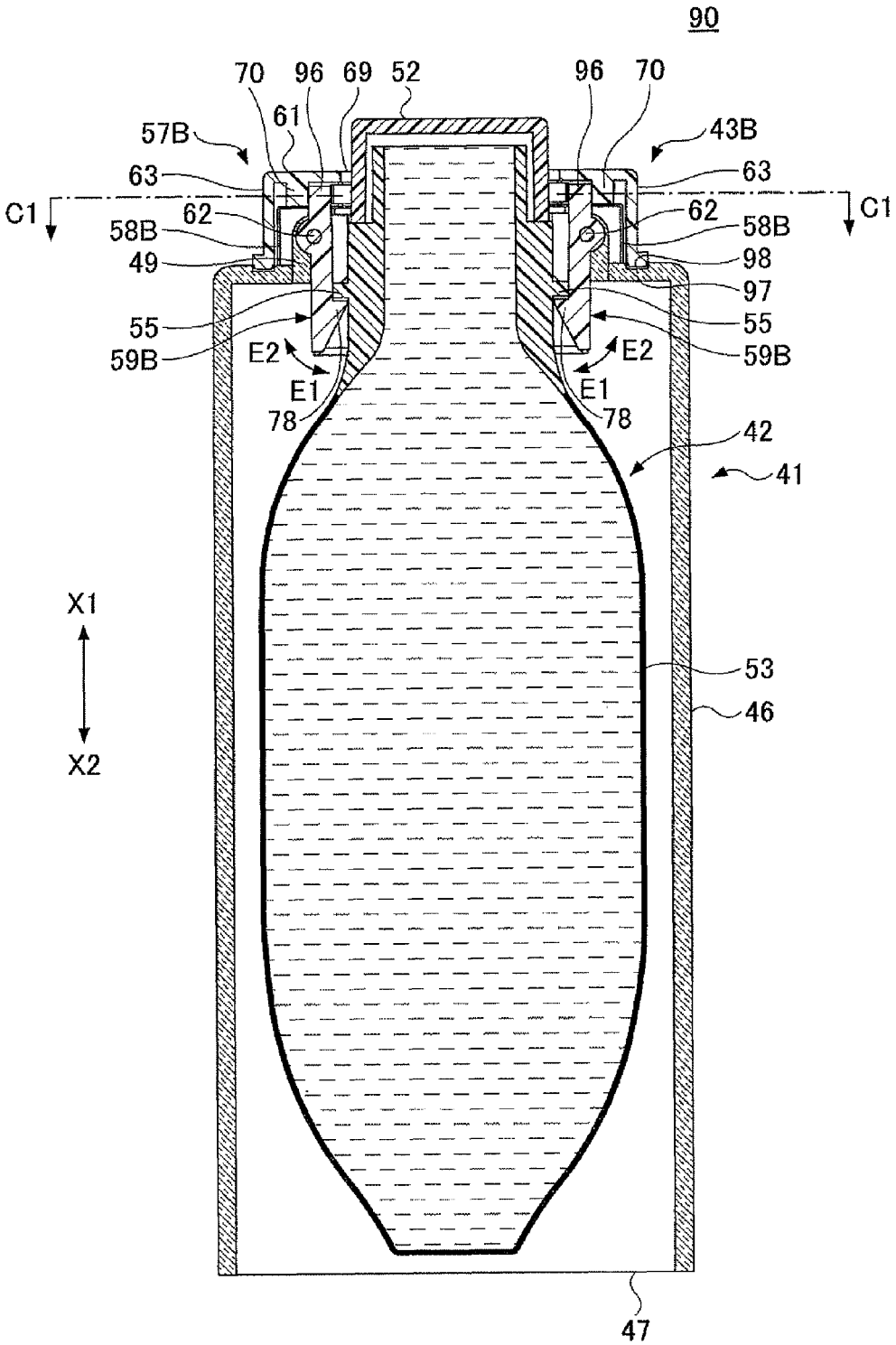
FIG. 14 is a cross-sectional view of a double container of Embodiment 3 of the present invention.
Figure 15:
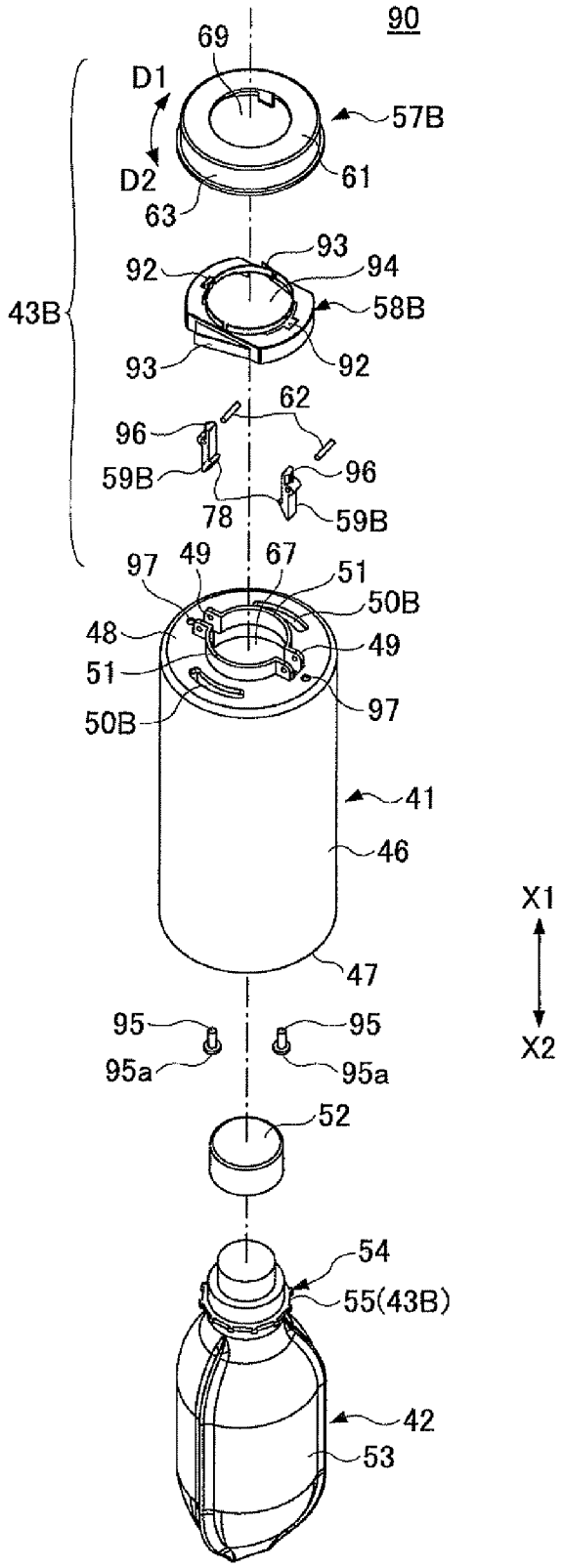
FIG. 15 is an exploded view of the double container of Embodiment 3 of the present invention.

Referring to FIG. 14 and FIG. 15, a ceiling 48 of a cylindrical body 46 includes bearing portions 49, penetrating apertures 50B, standing portions 51, a hanging portion 56 and an opening 67. The opening 67 is formed in a center of the ceiling 48, and the bearing portions 49 and the standing portions 51 are formed in the edge of the opening 67.

The bearing portions 49 support hook member 59B. With Embodiment 3, the hook members 59B are attached to the bearing portions 49 with pins 62. With Embodiment 3, two bearing portions 49 are arranged with intervals of 180°.

Further, on the outside of the standing portions 51 of the ceiling 48, two of the penetrating apertures 50B are formed. The opening 67 is formed between the two penetrating apertures 50B. The penetrating apertures 50B are shaped like a circular ark or a crescent and positioned to face each other interposing the opening 67 with an interval of 180°.

The penetrating apertures 50B are positioned at the bearing portions 49 with the intervals of 90°. The penetrating apertures 50B are covered by an operating cap 57B. Fixing threads 95 penetrate through the penetrating apertures 50B. Further, at predetermined positions of the ceiling 48, positioning dents 97 are formed to position the operating cap 57B relative to positioning bumps 98 formed in the operating cap 57B.

Figure 18:
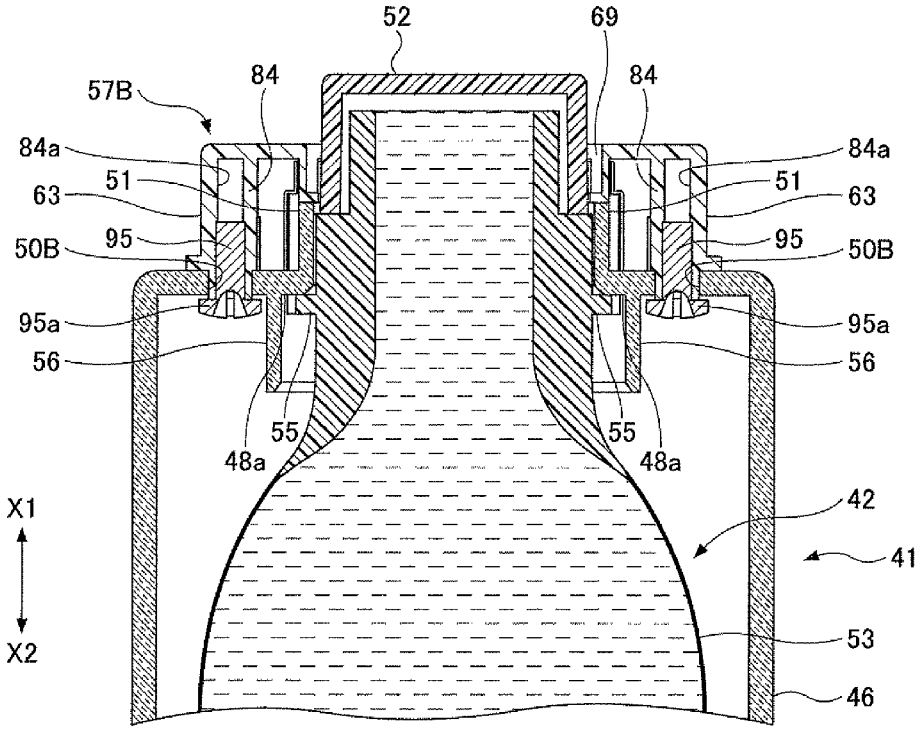
FIG. 18 is a perspective view of a spring member used for the double container of the Embodiment 3 of the present invention enlarging a fixing thread and a vicinity thereof.

On a back side of the ceiling 48, the hanging portion 56 is formed so as to downwardly extend (FIG. 18). The hanging portion 56 is provided at a position other than the bearing portions 49 and the inner diameter of the hanging portion 56 is larger than the inner diameter of the standing portion 51. Thus, also in Embodiment 3, a contact face 48*a* (a step) is formed inside the hanging portion 56 and on the back side of the ceiling 48.

The temporarily jointing and rotation preventing mechanism 43B includes a cogged flange 55 formed in the inner container 42, the operating cap 57B, a spring 58A, and the hook members 59B. The temporarily jointing and rotation preventing mechanism 43B is equivalent to a structure of integrating the temporarily jointing mechanism 13 with the rotation preventing mechanism 14 in Embodiment 1.

Figure 16:
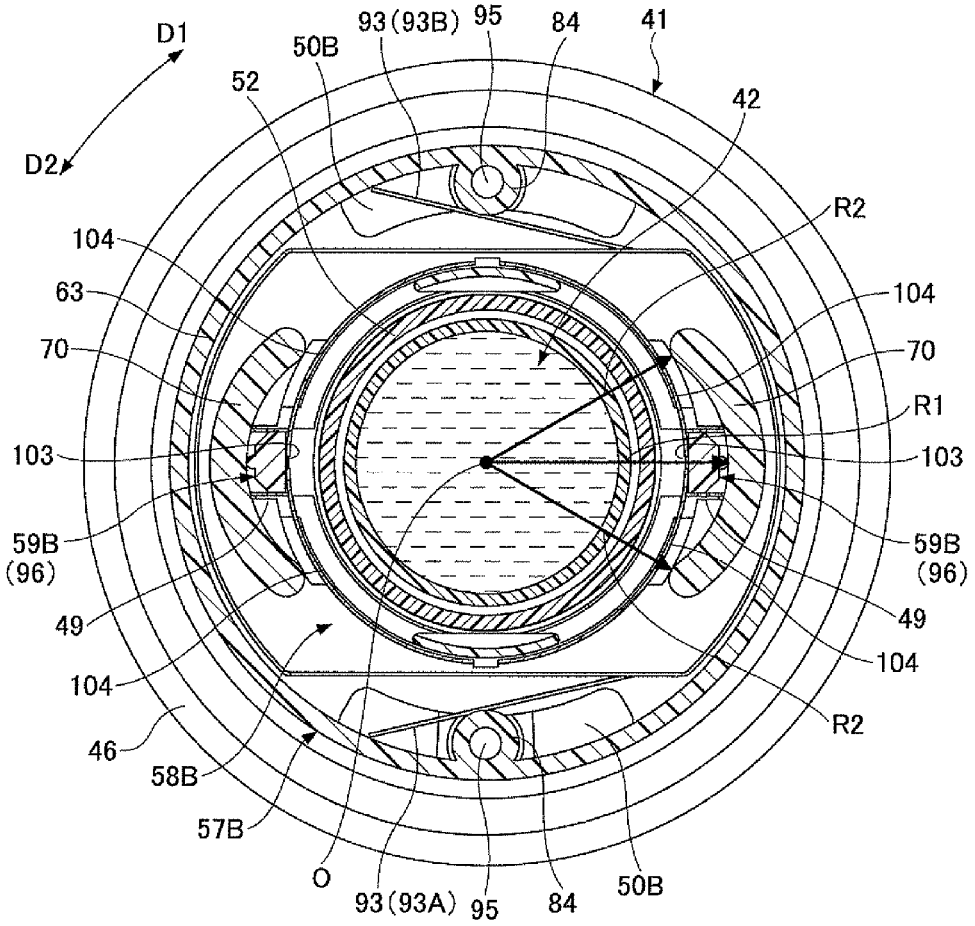
FIG. 16 is a cross-sectional view taken along a line C1-C1 of FIG. 14.

Referring to FIG. 16 in addition to FIG. 14 and FIG. 15, the operating cap 57B is described. FIG. 16 is a cross-sectional view taken along a line C1-C1 of FIG. 14.

The operating cap 57B includes an annular portion 61, a cylindrical portion 63, an opening 69, an operating portion 70, and a boss 84. The annular portion 61 is shaped like a ring. The annular portion 61 is held and operated when the double container 90 is handled. In the center of the annular portion 61, the opening 69 is formed.

The cylindrical portion 63 is provided to extend downward from the edge of the annular portion 61. When the operating cap 57B is attached to the outer container 41, a lower end portion of the cylindrical portion 63 slidably contacts the ceiling 48 of the outer container 41.

At the predetermined position of the lower end portion of the cylindrical portion 63, the positioning bumps 98 are formed which are engaged with the positioning dents 97 formed in the ceiling 48. When the positioning bumps 98 are engaged with the positioning dents 97, the operating cap 57B is positioned relative to the outer container 41. Hereinafter, the position of the operating cap 57B relative to the outer container 41 under a state in which the positioning dents 97 are engaged with the positioning bumps 98 is referred to as a reference position.

The operating portions 70 and the bosses 84 are formed on the back face of the annular portion 61. Referring to FIG. 16, the operating portions 70 and the bosses 84 are described.

The operating portions 70 are formed to extend in a downward direction X2 from the back face of the annular portion 61. The lengths of the operating portions 70 from the back side of the annular portion 61 are set to be smaller than the height of the cylindrical portion 63. As described later, the lengths of the operating portions 70 are set so as to be engaged with cams 96 of the hook members 59B.

Further, the operating portions 70 face interposing the opening 69 therebetween. The number of the operating portions 70 is two, and an interval of the operating portions 70 is 180°. The operating portions 70 are shaped like a curved crescent. Curvature factors of the operating portion 70 around a center point O of the annular portion 61 of the opening portion 69 are different between a center portion and end portions of the operating portion 70. Specifically, a radius R1 of the operating portion 70 in the center portion from the center point O is set longer than a radius R2 of the operating portion 70 in the end portions from the center point O (R1>R2).

The bosses 84 are formed to extend in a downward direction X2 from the back face of the annular portion 61. The length of the boss 84 from the back face of the annular portion 61 is greater than the height of the cylindrical portion 63. Specifically, the lengths of the bosses 84 and the positions of the bosses 84 are as enlarged in FIG. 18. Tip ends of the bosses 84 can be partly inserted into the insides of the penetrating apertures 50B which are formed in the ceiling 48.

A thread hole 84*a* is formed inside the boss 84. Fixing screws 95 are threadably inserted into the thread holes 84*a* from the inside of the outer container 41. Specifically, when the operating cap 57B is attached to the outer container 41, the spring 58B described later is mounted on the outer container 41. Thereafter, the operating cap 57B is attached to the outer container 41.

Heads 95*a* of the fixing screws 95 are larger than the penetrating apertures 50B. Therefore, after the fixing screws 95 are threadably inserted into the thread holes 84*a*, the heads 95*a* are engaged with the back face of the ceiling 48. Thus, the operating cap 57B is attached to the outer container 41.

As described, the penetrating apertures 50B are elongated holes having the circular arc shape (the crescent shape). Therefore, the bosses 84 and the fixing screws 95 are movable along the penetrating apertures 50B. By grasping and rotating the operating cap 57B, the operating cap 57B is rotated in the directions D1 and d2 relative to the outer container 41. Further, by the rotation of the operating cap 57B, the operating portion 70 is also rotated.

Further, the forming portions of the operating portions 70 and the bosses 84 are set to be separated by 90°. A positional relationship between the operating portions 70 and the bosses 84 is described later when the hook member 59B is described later for convenience of the explanation.

Figure 17:
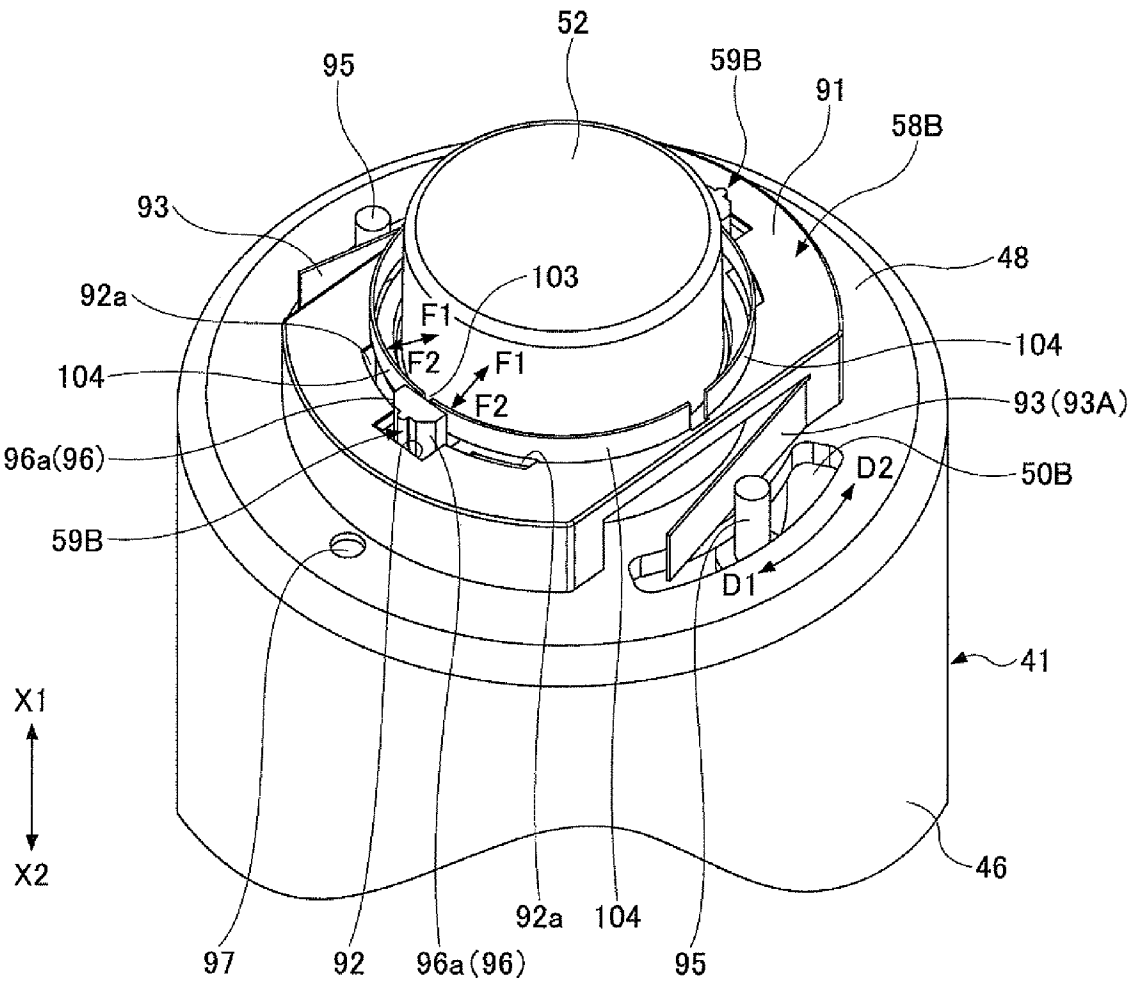
FIG. 17 is an enlarged perspective view of a spring member used for the double container of the Embodiment 3 of the present invention.

Referring to FIG. 17 in addition to FIG. 14 and FIG. 15, the spring 585 is described.

The spring 58B is made of a flexible material (a resin or a metallic material such as stainless). The spring 585 includes a body 91, penetrating apertures 92, spring portions 93 and a spring portion 104.

The body 91 is fixed to the outer container 41 so as to cover the standing portion 51 formed on the ceiling 48. On the upper surface of the body 91, an opening 94 is formed. The diameter of the opening 94 is large enough to insert the installing portion 54 to which the cap 52 is attached.

The pair of the spring portions 93 may be shaped like cantilever springs. Referring to FIG. 16, the spring portions 93 are connected to the body 91 on the right ends of the spring portions 93 and leftward and outwardly biased from the body 91 so as to have a V shape in their plan views.

When the bosses 84 are attached to the outer container 41, the bosses 84 and the fixing screws 95 are engaged with the spring portions 93. Specifically, the bosses 84 are engaged with the spring portions 93 on the outsides of the spring portions 93. Referring to FIG. 17, the operating cap 57B is omitted to illustrate that the fixing screws 95 are engaged with the spring portions 93.

If the operating cap 57B is rotated in a clockwise direction of an arrow D1 in its plan view, the bosses 84 and the fixing screws 95 are rotated in the direction D1. Therefore, referring to FIG. 16, the spring portions 93 (especially indicated by reference symbol 93A) are pushed by the boss 84 and the fixing screw 95 to cause generation of the elastic force.

On the contrary, referring to FIG. 16, the spring portions 93 (especially indicated by reference symbol 938) relatively move in a direction of departing from the bosses 84 and the fixing screws 95. Then, the generation of the elastic force is not caused.

After grasping and rotating the operating cap 57B in the clockwise direction of the arrow D1 in its plan view and releasing the grasping of the operation cap 57B, the spring portions 93A are elastically restored to bias the bosses 84 and the fixing screws 95 to rotate the operating cap 57B in the direction of D2. Thus, the operating cap is returned to its original position. If the operating cap 578 is rotated in the counter-clockwise direction of the arrow D2 in its plan view, the operating cap 57B and the spring 58B function to perform an operation reverse to the above-described operation, an explanation of which is omitted.

Meanwhile, penetrating apertures 92, grooves 92*a*, spring portions 104 and so on are formed around the edge of the opening 94 of the spring 58B. The cams 96 positioned at the upper portions of the hook members 59B are inserted into the penetrating apertures 92. On both sides of the penetrating apertures 92, grooves 92*a* in circular arc shapes are formed in predetermined ranges.

The spring portion 104 is provided along the edge of the opening 94 and stands from the upper surface of the body 91. The spring portion 104 has slits 103 at positions facing the cams 96.

The grooves 92 are formed on the both sides of the slit 103. Therefore, the spring portion 104 is elastically deformed in directions F1 and F2 illustrated in FIG. 17 of the radius of the spring portion 104.

Next, the hook members 59B are described.

The hook member 595 may be produced by resin molding (a resin molded product) and a hook 78 and the cam 96 are integrally formed as illustrated in FIG. 15. With Embodiment 3, the hook members 59B have shaft holes. After positioning the hook members 59B in the bearing portions 49, the pins 62 are inserted into the shaft holes to support the hook members 59B in the bearing portions 49.

The hooks 78 are positioned inside and below the opening 67 under a state in which the hook members 59B are installed in the bearing portions 49. When the inner container 42 is installed in the outer container 41, the hooks 78 are engaged with the cogged flange 55.

The cams 96 extend upward from the pins 62 when the hook members 59B are installed in the bearing portions 49. Referring to FIG. 17, the cams 96 partly protrude from the penetrating apertures 92 in the upper direction X1 when the spring 58B is attached to the outer container 41.

The protruded portions of the cams 96 correspond to and face the spring portions 104 of the above-described spring 58B. As described, the protruded portions of the cams 96 face the slits 103 of the spring portions 104. When the operating cap 57B is attached to the outer container 41, the operating portions 70 formed in the operating cap 57B face the cams 96.

Referring to FIG. 16, when the operating cap 57B is in the reference position relative to the outer container 41, the cams 96 face center positions of the operating portions 70. As described, a distance R1 between the center of the operating portion 70 and a rotational center O of the operating portion 70 is longer than a distance R2 between both ends of the operating portion 70 and the rotational center O of the operating portion 70.

Therefore, in the reference position where the cam 96 faces the center of the operating portion 70, the cam 96 is separated from the operating portion 70 or not biased even if the cam 96 is in contact with the operating portion 70. At this time, the hook members 59B are parallel to the vertical directions of X1 and X2 as illustrated in FIG. 14. Hereinafter, this state is referred to as a temporarily jointed state.

On the contrary, if the operating cap 57B is rotated in the direction of D1 or D2 from the reference position, the operating portions 70 are also rotated to cause the cams 96 to face the ends of the operating portions 70. Since the distance R2 between the ends of the operating portion 70 and the rotational center O is shorter than the distance R1 between the center of the operating portion 70 and the rotational center O, the cam is biased to be pushed toward the inside in the direction of F1 in FIG. 17 along with the rotation of the operating portion 70.

Figure 19:
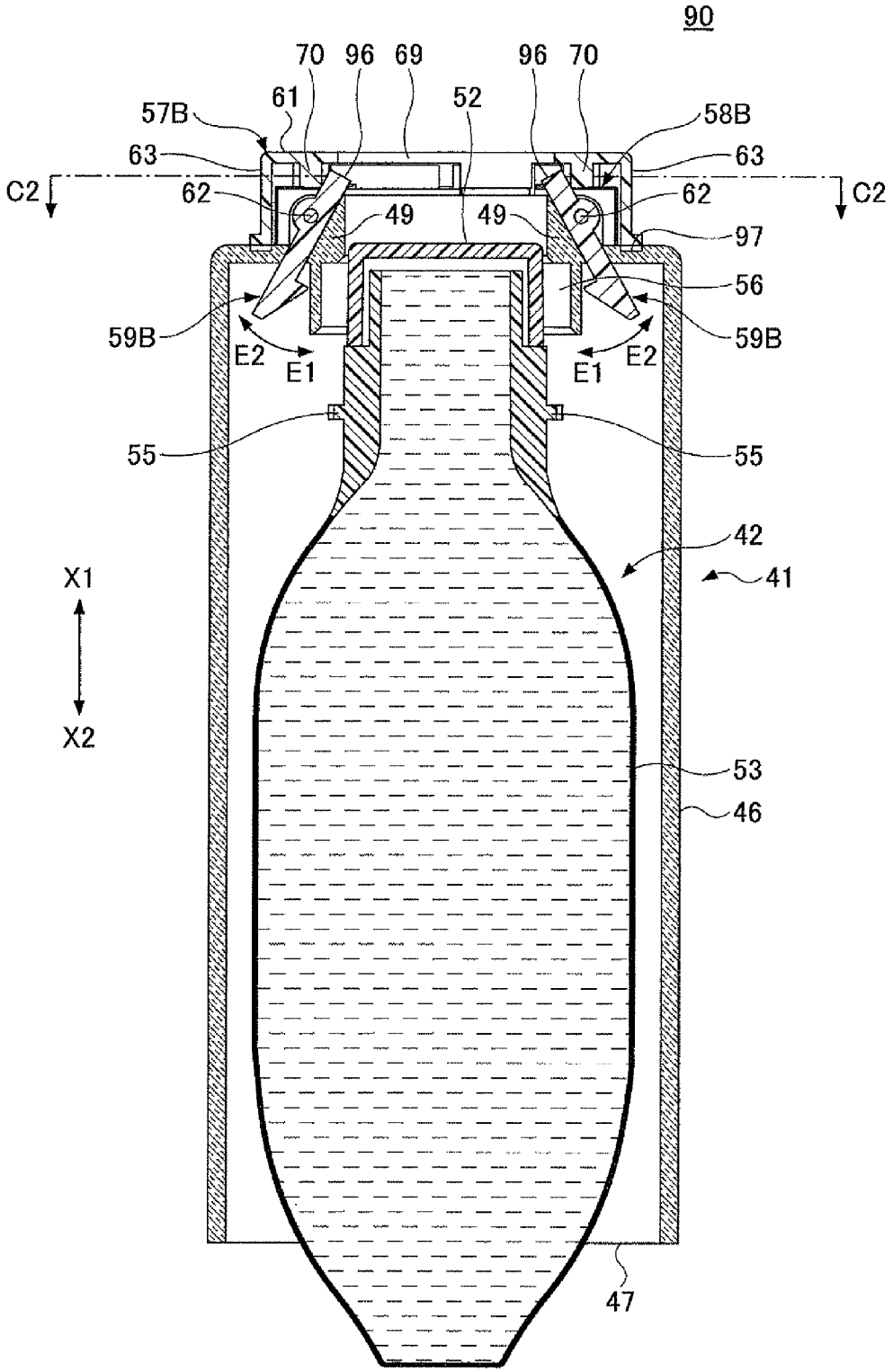
FIG. 19 is a cross-sectional view of a double container of Embodiment 3 of the present invention where a temporary joint is released.
Figure 20:
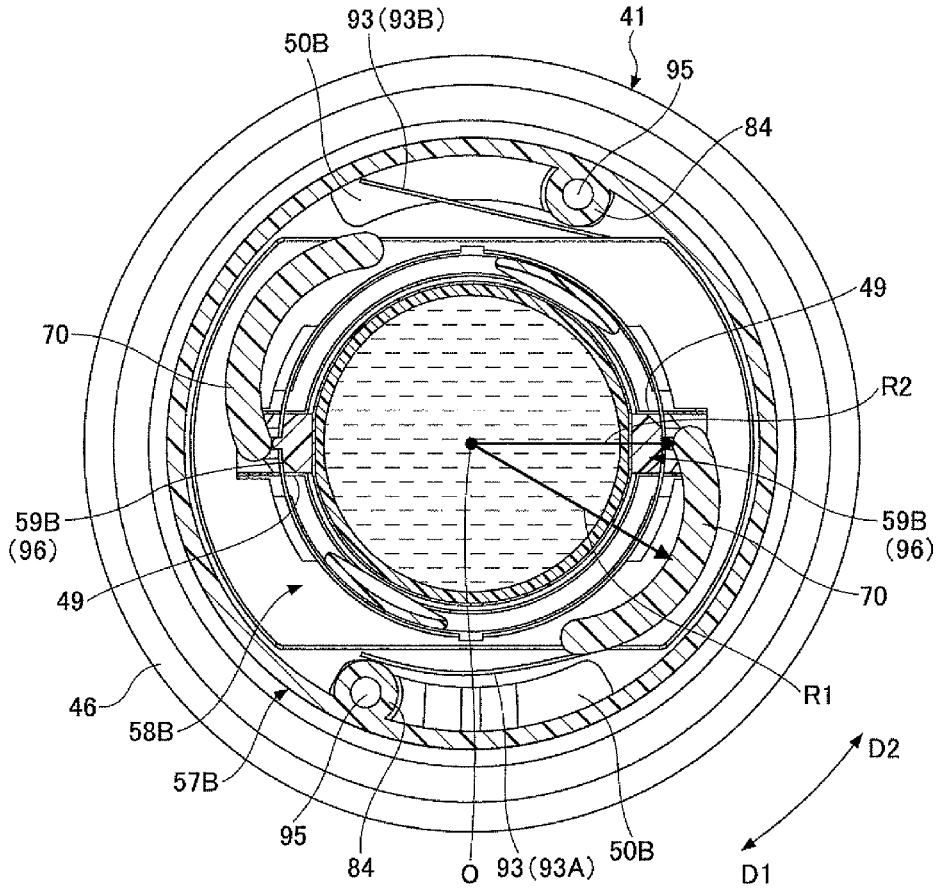
FIG. 20 is a cross-sectional view taken along a line C2-C2 of FIG. 19.

Referring to FIG. 20, the cams 96 face the ends of the operating portions 70 with the rotation of the operating cap 57B in the direction of D1. With this, the hook members 59B are rotated in the direction of E2 around the pins 62 as illustrated in FIG. 19. Hereinafter, this state is referred to as a temporary joint releasing state.

Further, oblique faces 96*a*, 96*a* are formed on both sides of the cams 96 as illustrated in FIG. 17. By providing the oblique faces 96*a*, 96*a* on the cam 96, it is possible to make sliding motion between the operating portions 70 and the cams 96 smooth.

Inner side surfaces of the cams 96 (surfaces opposite to the surfaces facing the operating portions 70) face the spring portion 104. By biasing the cam 96 in the direction F1 illustrated in FIG. 17, the spring portion 104 is pushed by the cams 96 to be elastically deformed. By releasing the operation of the operating cap 57B, the spring portion 104 is elastically restored and outwardly biases the cam 96 in the direction of the arrow F2. With this, the hook members 59B are returned to the temporarily jointed state.

Subsequently, an operation of installing the inner container 42 in the outer container 41 and an operation of separating the inner container 42 from the outer container 41 in the double container 90 are described.

In order to install the inner container 42 in the outer container 41, the inner container 42 is inserted into the cylindrical body 46 of the outer container 41 from the bottom opening 47. Therefore, by inserting the inner container 42 in the outer container 41, the cap 52 and the installing unit 54 are sequentially inserted in the openings 67, 92 and 69.

Referring to FIG. 19, before the inner container 32 is inserted in the outer container 41, the operating cap 573 is positioned at the reference position. Therefore, the hook members 593 are rotated in the direction E1 so as to be parallel to the vertical directions of X1 and X2. Under the state, the hooks 78 protrude inside the opening 67.

Because the cap 52 and the installing unit 54 are inserted in the openings 67, 69 and 94, the sizes of the cap 52 and the installing unit 54 are small enough to prevent engagement with the hook members 59B. The size of the cogged flange 55 is enabled to be engaged with the hooks 78. Therefore, when the inner container 42 is inserted in the outer container 41, the cogged flange 55 is in contact with the hooks 78 of the hook members 59B.

The hooks 78 have oblique faces. Therefore, the further the inner container 42 advances in the direction X1, the more the cogged flange 55 pushes the oblique faces. With this, the hook members 593 move in the direction of the arrows E2. At this time, the cams 96 formed in upper portions of the hook members 593 push the spring portions 104 in an inward direction F1 in FIG. 17.

If the cogged flange 55 climbs over the hooks 78, the cams 96 are biased in the outward direction F2 in FIG. 2 by the elastic restoring force of the spring portions 104.

Under this temporarily jointed state, the upper surface of the cogged flange 55 is in contact with the contact faces 48*a* of the outer container 41 as illustrated in FIG. 18, and the lower surface of the cogged flange 55 is engaged with the hooks 78. Therefore, the inner container 42 is temporarily jointed to the outer container 41 firmly without gaps. Therefore, if the inner container 42 is biased in the downward direction X2 relative to the outer container 41, the inner container 42 is prevented from being separated. FIG. 14 illustrates a state in which the inner container 42 is temporarily jointed to the outer container 41.

Under the temporarily jointed state, the hook members 59B are positioned inside the slots 55*b* of the cogged flange 55 in a similar manner to Embodiment 2. Therefore, if the inner container 42 is forced to rotate relative to the outer container 41, sides of the hook members 59B are in contact with the cogs 55*a* to thereby prevent the hook members 59B from rotating.

The removal of the cap 52 and the installation of the dispenser device 90 are the same as those described in Embodiment 2. Therefore, the explanation is omitted. The removal of the cap 52 and the installation of the dispenser device 90 can be easily carried out since the rotation of the inner container 42 relative to the outer container 41 is prevented.

Next, an operation of replacing the used inner container 42 with a new inner container 42 in the double container 90 of Embodiment 3 is described.

In order to replace the inner container 42, the dispenser device 90 is first removed from the installing unit 54 of the inner container 42. Since the inner container 42 is prevented from rotating relative to the outer container 41 by the temporarily jointing and rotation preventing mechanism 43B, it is possible to remove the dispenser 90 with good operability. Further, since the temporarily jointing and rotation preventing mechanism 43B maintains the temporarily jointed state of the inner container 42, the inner container 42 is prevented from being dropped from the outer container 41.

On the other hand, in order to remove the inner container 42 from the outer container 41, the operating cap 57B is grasped and rotated in the clockwise direction D1 or the counterclockwise direction D2 from the reference position. Along with the rotation of the operating cap 57B, the operating portions 70, the bosses 84 and the fixing screws 95 rotate.

As described, by the rotation of the operating portion 70 from the reference position, the cams 96 of the hook members 59B are biased in the inward direction by the operating portions 70 and the hook members 598 are rotated in the direction E2 around the pins 62. With this, the hooks 78 are separated from the cogged flange 55 to be released from the temporary joint and from the prevention of the rotation. Therefore, the temporary joint with the temporarily jointing and rotation preventing mechanism 438 is released, and the inner container 42 can be removed from outer container 41.

Further, by the rotation of the boss 84, the spring portions 93 are biased in the inward directions by the rotating bosses 84 to cause elastic deformation of the spring portions 93. At this time, the spring portion 93A is elastically deformed when the operating cap 57B is rotated in the direction D1 as illustrated in FIG. 20. The spring portion 93B is elastically deformed when the operating cap 57B is rotated in the direction D2 (FIG. 16 and FIG. 20).

When the temporary joint is released, the operator stops to touch the operating cap 57B. With this, the spring portions are elastically restored and the bosses 84 are elastically biased toward the reference position. With this bias force, the operating cap 57B is rotated toward the reference position.

With the rotation of the operating cap 57B toward the reference position, the operating portion 70 also rotates toward the reference position. With this, the cams 96 move in the outward direction of the arrow F2 by the elastic restoring force of the spring portions 104 and the hook members 59B return again to the temporarily jointing position in parallel to the directions X1 and X2. With the above operation, the temporarily jointing and rotation preventing mechanism 433 returns to the temporarily jointed state.

As described, the operation of installing the inner container 42 in the outer container 41, and the operation of separating the inner container 42 from the outer container 41 can be easily carried out in the double container 90 of Embodiment 3. Further, the inner container 42 may be temporarily jointed to the outer container with ease by only inserting the installing unit 54 of the inner container 42 into the installing neck 18 (see FIG. 13B) of the outer container 41. In order to eject the inner container 42 from the outer container 41, it is sufficient to rotate the operating cap 57B. Therefore, the ejecting process of the inner container 42 becomes easy.

Next, Embodiment 4 of the present invention is described.

Figure 21:
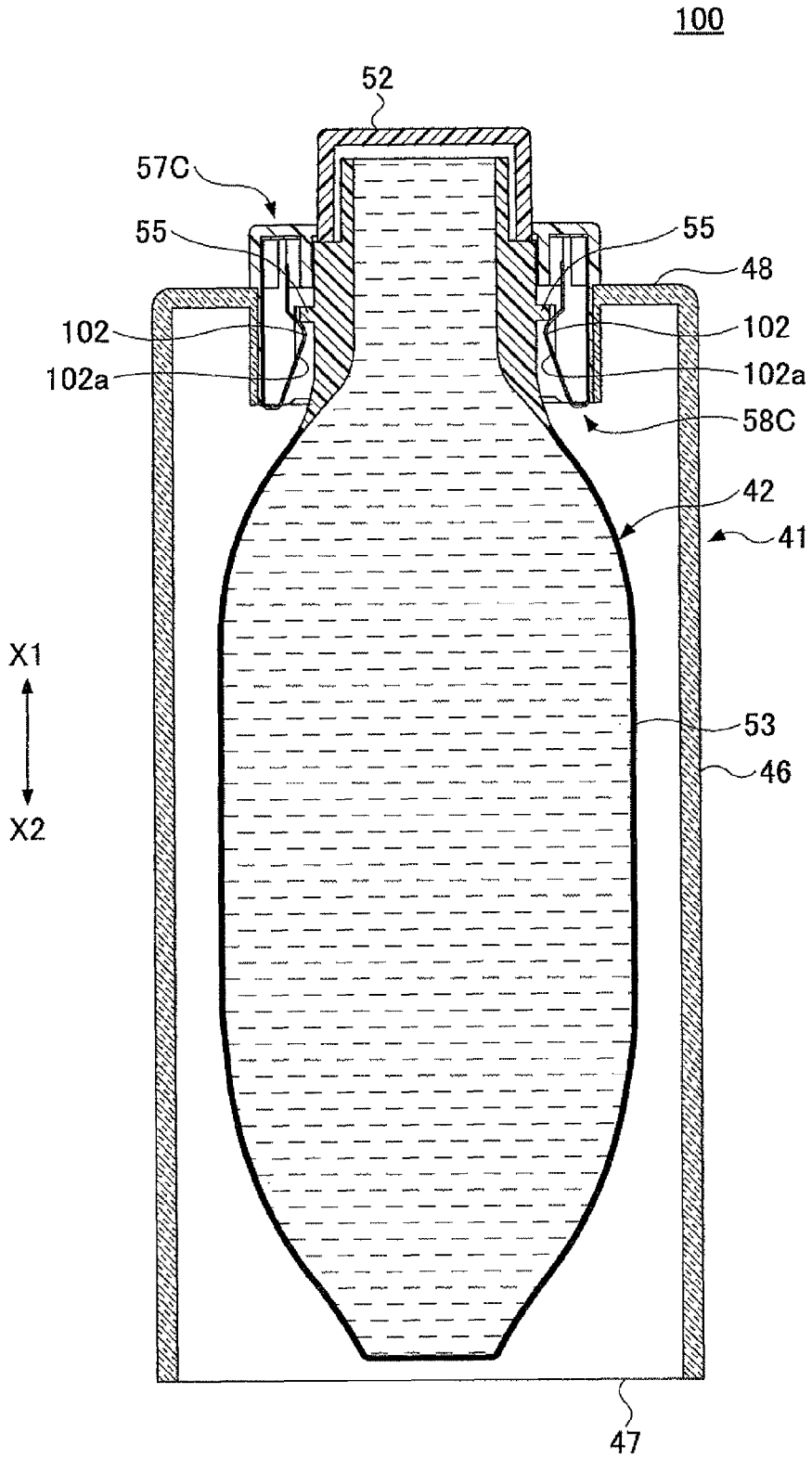
FIG. 21 is a cross-sectional view of a double container of Embodiment 4 of the present invention.
Figure 22:
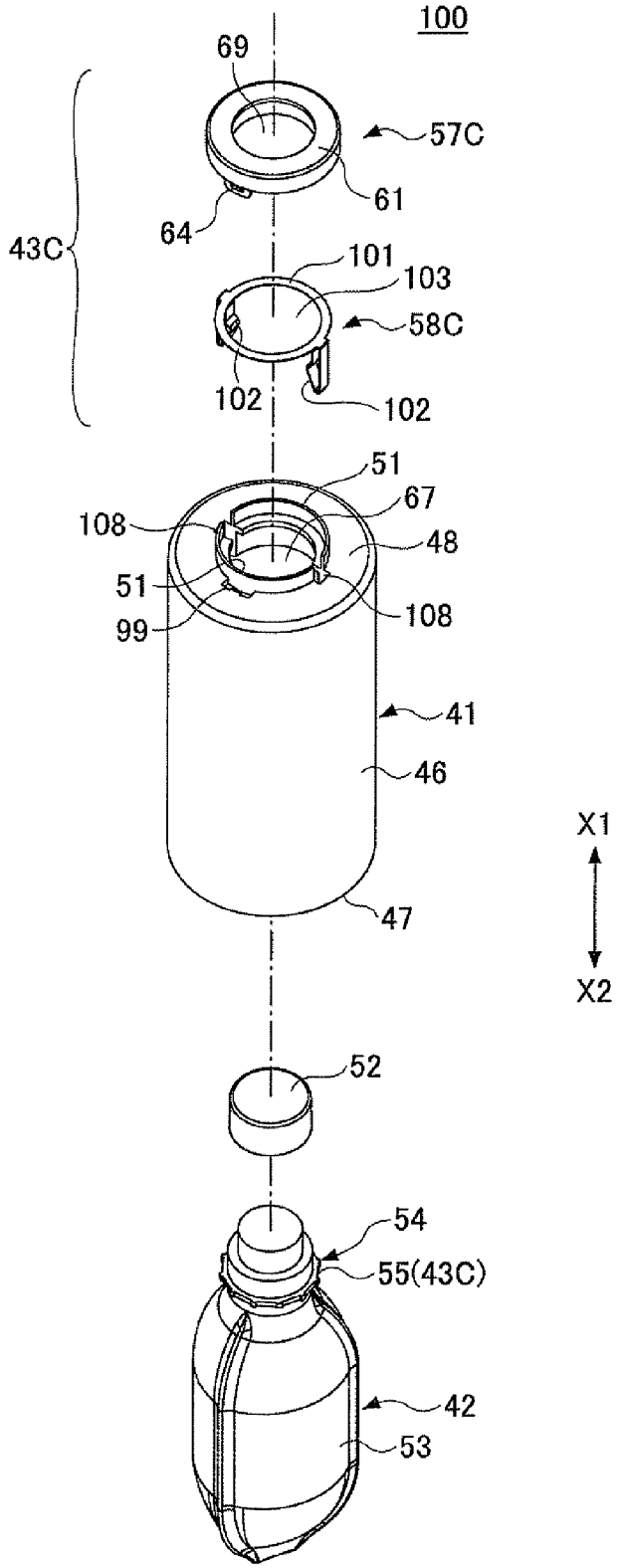
FIG. 22 is an exploded view of the double container of Embodiment 4 of the present invention.
Figure 23:
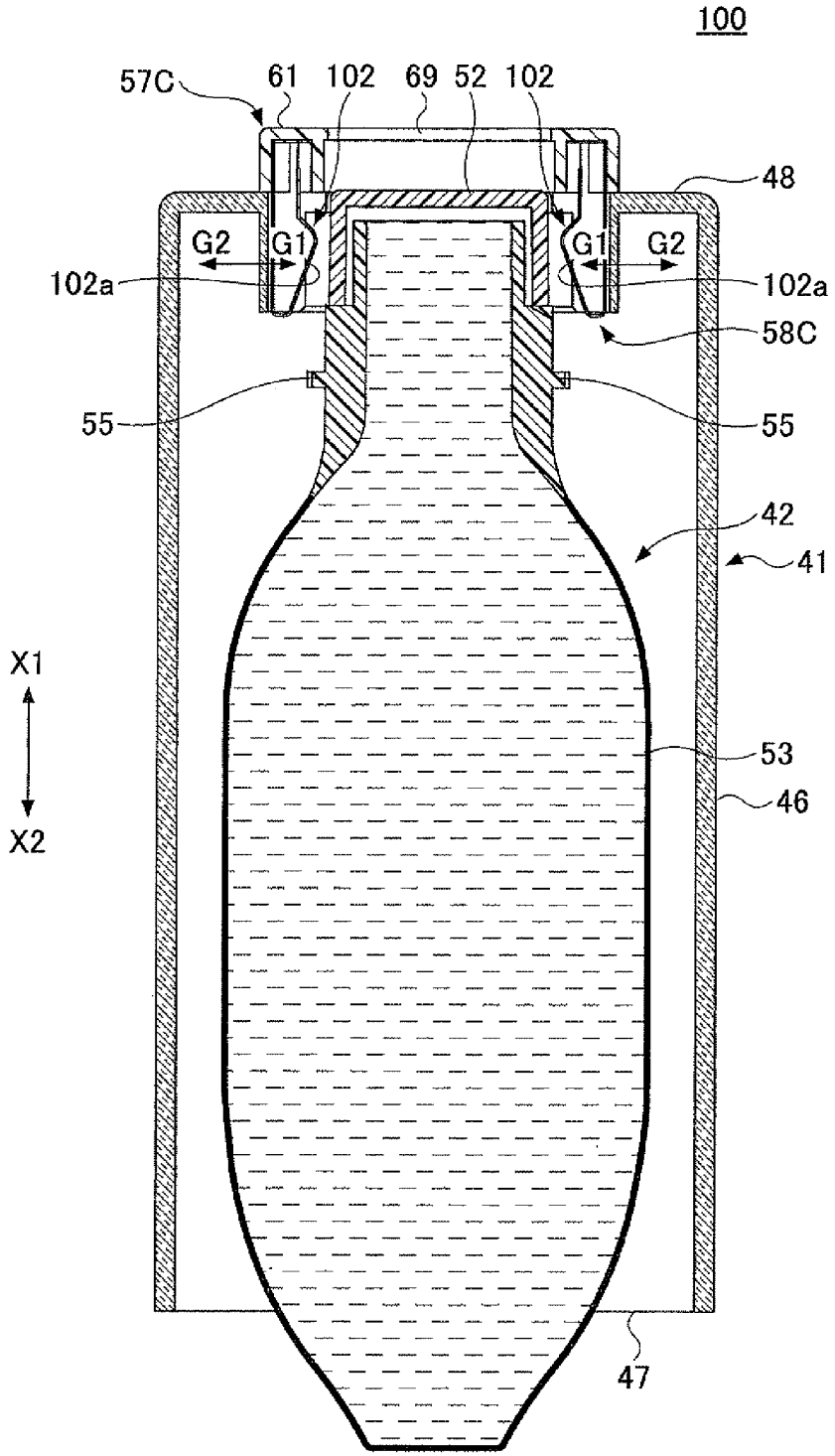
FIG. 23 is a cross-sectional view of the double container of Embodiment 4 of the present invention where a temporary joint is released.

FIG. 21 thru FIG. 23 illustrate a double container 100 of Embodiment 4 of the present invention. Referring to FIG. 21 to FIG. 23, the same reference symbols are attached to structural elements corresponding to the structural elements of the double container 10A, 10B, 40 and 90 of Embodiments 1 to 3 illustrated in FIG. 1 to FIG. 20 and descriptions of these structural elements are omitted.

A double container 100 of Embodiment 4 includes an outer container 41, an inner container 42, a temporarily jointing and rotation preventing mechanism 43C and so on. With Embodiment 3, a cosmetic container is exemplified as the double container 100.

The temporarily jointing and rotation preventing mechanism 43C of Embodiment 4 includes a spring 58C. The spring 58C resembles the temporarily jointing member 30 of Embodiment 1 illustrated in FIG. 1 to FIG. 5. Although the temporarily jointing member 30 only has a temporarily jointing function, the spring 58C has both functions of temporarily jointing the inner container 42 to the outer container 41 and preventing rotation of the inner container 42 relative to the outer container 41.

The operating cap 57C is made of a resin and has an annular portion 61 having a cam 96 in a center of the annular portion 61. A hook portion 64 extends downward from a side of the annular portion 61.

The spring 58C is made of an elastic resin or a metal. Stainless steel is used for the spring 58C in Embodiment 4. The spring 58C includes a ceiling 101 and hook portions 102.

The ceiling 101 has an opening 103 in a center of the ceiling 101 to be in a ring-like shape. Referring to FIG. 21, the hook portions 102 are bent to have a substantially U-like shape. Therefore, the hook portions 102 are pushed to elastically deform.

Insertion holes 108 for receiving the hook portions 102 and an attachment hole 99 for receiving the hook portion 64 are formed in a ceiling 48 of the outer container 41. An opening 67 is formed in the ceiling 48, and standing portions 51 in circular annular shapes stand from an outside of the inner periphery of the opening 67.

The ceiling 101 of the spring 58C is installed inside the standing portions 51. Referring to FIG. 21, the standing portions 51 are disposed and the hook portions 102 pass through the insertion holes 108 and protrude from the back surface side of the ceiling 48.

After the spring 58C is installed in the outer container 41, the operating cap 57C is attached to the outer container 41 from the upper side of the outer container 41. At this time, a protrusion is formed inside the attachment hole 99 and a recess engaging with the protrusion is formed in the hook portion 64. The hook portion 64 is inserted in the attachment hole 99 to thereby engage the recess with the protrusion. Thus, the operating cap 57C is attached to the outer container 41. By attaching the operating cap 57C to the outer container 41, the spring 58C is prevented from separating from the outer container 41.

Subsequently, an operation of installing the inner container 42 in the outer container 41 and an operation of separating the inner container 42 from the outer container 41 in the double container 100 are described.

In order to install the inner container 42 in the outer container 41, the inner container 42 is inserted into a cylindrical body 46 of the outer container 41 from the bottom opening 47. Therefore, by inserting the inner container 42 in the outer container 41, a cap 52 and an installing unit 54 are sequentially inserted in the openings 67, 103 and 69. Before the inner container 42 is installed in the outer container 41, the hook portions 102 protrude inside the opening 67.

A cogged flange 55 formed in the inner container 42 has a size enabling engagement with the hook portions 102. Therefore, when the inner container 42 is inserted in the outer container 41, the cogged flange 55 is in contact with the hook portions 102. The hook portion 102 includes an oblique face 102*a* on a side facing the cogged flange 55.

Therefore, the further the inner container 42 advances in the direction X1, the more the cogged flange 55 pushes the oblique faces 102*a*. With this, the hook portions 102 elastically deform in directions indicated by arrows G2 in FIG. 23. Then, when the cogged flange 55 climbs over the oblique faces 102*a*, the hook portions 102 are elastically restored in the inward directions GI illustrated in FIG. 23. Thus, the spring 58C is engaged with the cogged flange 55.

Under this state, the upper surface of the cogged flange 55 is in contact with a contact face 48*a* (not illustrated), and the lower surface of the cogged flange 55 is engaged by the hook portions 102. Therefore, the inner container 42 is temporarily jointed to the outer container 41 firmly without gaps. Therefore, if the inner container 42 is biased in the downward direction X2 relative to the outer container 41, the inner container 42 is prevented from being separated. FIG. 21 illustrates a state in which the inner container 42 is temporarily jointed to the outer container 41.

Under the temporarily jointed state, the hook portions 102 are positioned at the insides of the slots 55*b* in a similar manner to Embodiments 2 and 3. Therefore, if the inner container 42 is forced to rotate relative to the outer container 41, sides of the hook portions 102 are in contact with the cogs 55*a* to thereby prevent the hook portions 102 from rotating.

The removal of the cap 52 and the installation of the dispenser device 90 are the same as those described in Embodiment 2. Therefore, the explanation is omitted. The removal of the cap 52 and the installation of the dispenser device 90 can be easily carried out since the rotation of the inner container 42 relative to the outer container 41 is prevented.

Next, an operation of replacing the used inner container 42 to a new inner container 42 in the double container 100 of Embodiment 4 is described.

In order to replace the inner container 42, the dispenser device 90 is first removed from the installing unit 54 of the inner container 42. Since the inner container 42 is prevented from rotating relative to the outer container 41 by the temporarily jointing and rotation preventing mechanism 43C, it is possible to remove the dispenser 90 with good operability. Further, the inner container 42 is prevented from being dropped from the outer container 41.

On the other hand, in order to remove the inner container 42 from the outer container 41, a portion of the inner container 42 protruding from the operating cap 57C is pushed in the downward direction X2. With this, the cogged flange 55 in moved in the direction X2. After the cogged flange 55 climbs over a portion of the hook portions 102 inwardly protruding from the hook portions 102, the engagement between the cogged flange 55 and the operating cap 57C is released. With this, the inner container 42 can be removed from the outer container 41. FIG. 23 illustrates a temporary joint releasing state.

As described, the double container 100 can be inserted in the outer container 41 temporarily jointing the inner container 42. The temporary jointing state can be released by pushing the portion of the inner container 42 protruding from the operating cap 57C. Thus, the inner container 42 can be temporarily jointed to the outer container 41 or released from the temporary joint with the outer container 41.

Next, Embodiment 5 of the present invention is described.

Figure 24:
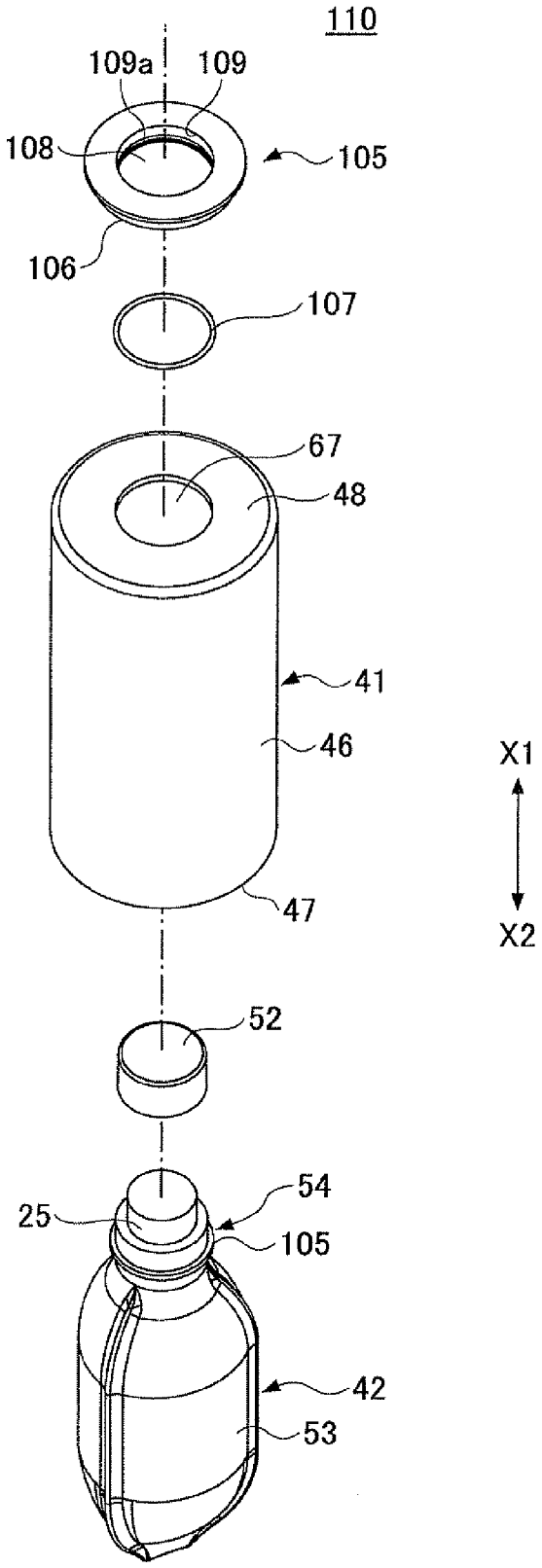
FIG. 24 is an exploded view of a double container of Embodiment 5 of the present invention.
Figure 25:
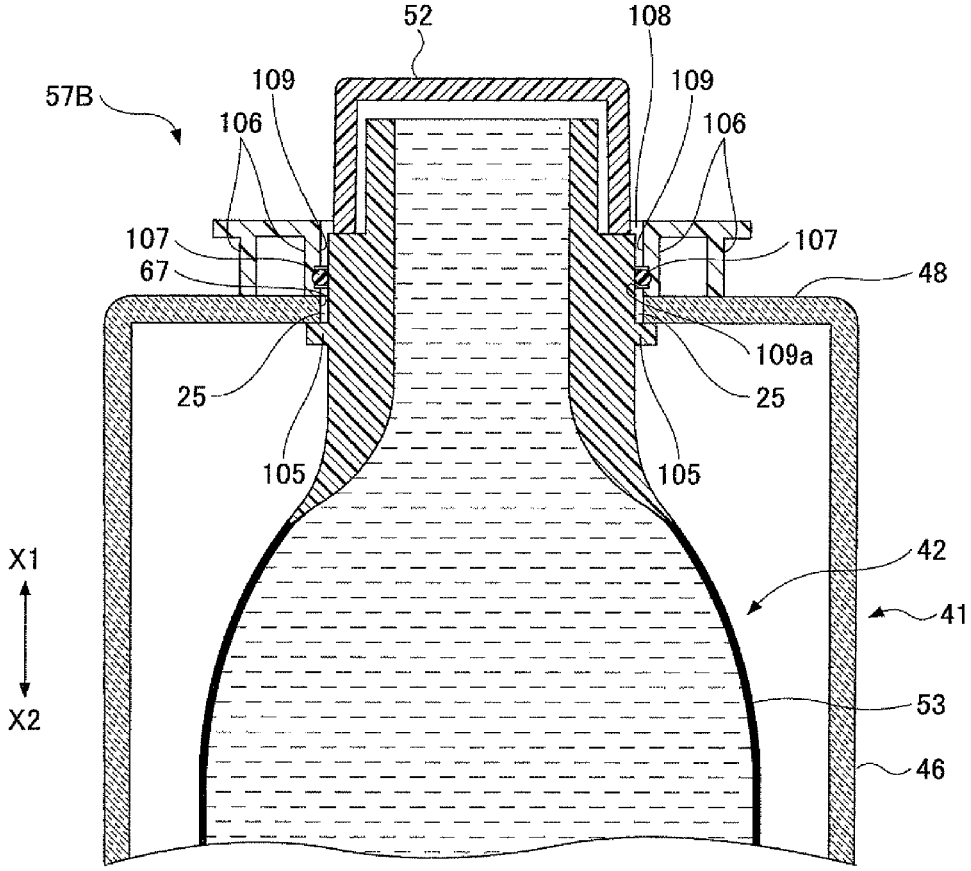
FIG. 25 is a cross-sectional view of the double container of Embodiment 5 of the present invention enlarging an O-ring and a vicinity thereof.

FIG. 24 and FIG. 25 illustrate a double container 110 of Embodiment 5 of the present invention. Referring to FIG. 24 to FIG. 25, the same reference symbols are attached to structural elements corresponding to the structural elements of the double container 10A, 10B, 40, 90 and 100 of Embodiments 1 to 4 illustrated in FIG. 1 to FIG. 23 and descriptions of these structural elements are omitted.

With the double container 110 of Embodiment 5, the temporarily jointing and rotation preventing mechanism is made of an O ring 107.

An operation cap 105 is fixed to a ceiling 48 of an outer container 41 by bonding or the like. The operation cap 105 is made of a resin and has an opening 108 in the center of the operation cap 105. A hanging portion 106 is formed on the lower surface of the operation cap 105. The hanging portion 106 includes two parts of an inner part and an outer part.

An inner peripheral wall 109 of the inner part of the hanging portion 106 has a groove 109*a* in an annular shape. The O-ring 107 is installed in the groove 109*a*. When the O-ring 107 is installed in the groove 109*a*, the O-ring 107 protrudes from a surface of the inner wall 109 as illustrated in FIG. 25.

Further, the cogged flange 55 is not formed in an installing unit 54 of an inner container 42 in Embodiment 5 and simply shaped like a cylinder.

Subsequently, an operation of installing the inner container 42 in the outer container 41 and an operation of separating the inner container 42 from the outer container 41 in the double container 110 are described.

In order to install the inner container 42 in the outer container 41, the inner container 42 is inserted into the cylindrical body 46 of the outer container 41 from a bottom opening 47. Because the outer diameter of the O-ring 107 is larger than the inner diameter of the inner wall 109, the O-ring 107 protrudes from the surface of the inner wall 109 as described above. Further, the inner diameter of the O-ring 107 is smaller than the outer diameter of a tubular portion 25 of the inner container 42. Therefore, when the tubular portion 25 of the inner container 42 is inserted in the openings 67 and 108, the O-ring 107 is in close contact with the tubular portion 25 (a temporary jointing state).

Under the temporarily jointing state, the O-ring 107 is pressed against the tubular portion 25 to thereby prevent the inner container 42 from playing inside the outer container 41. FIG. 25 illustrates a state in which the inner container 42 is temporarily jointed to the outer container 41. Since the O-ring 107 is in contact with the tubular portion 25 along the entire periphery of the O-ring 107, the inner container 42 cannot be easily moved if the inner container 42 is forced to rotate relative to the outer container 41.

On the other hand, when the used inner container 42 is replaced by a new inner container 42 in the double container 110, the used inner container 42 is pulled out of the outer container 41. The pulling force may be more than a contact force between the O-ring 107 and the tubular portion 25.

As described, in the double container 110 of Embodiment 5, the inner container 42 can be temporarily jointed to the outer container 41 with a simple structure. Forming a temporary joint and releasing the temporary joint can be carried out by inserting the inner container 42 in the outer container 41 and pulling out the inner container 42 from the outer container 41.

Meanwhile, in the above Embodiments, the cosmetic containers to which the dispenser device 90 is attached have been described as the double containers. However, the present invention is not limited to these and also applicable to the other containers without using the dispenser device 90.

Figure 26:
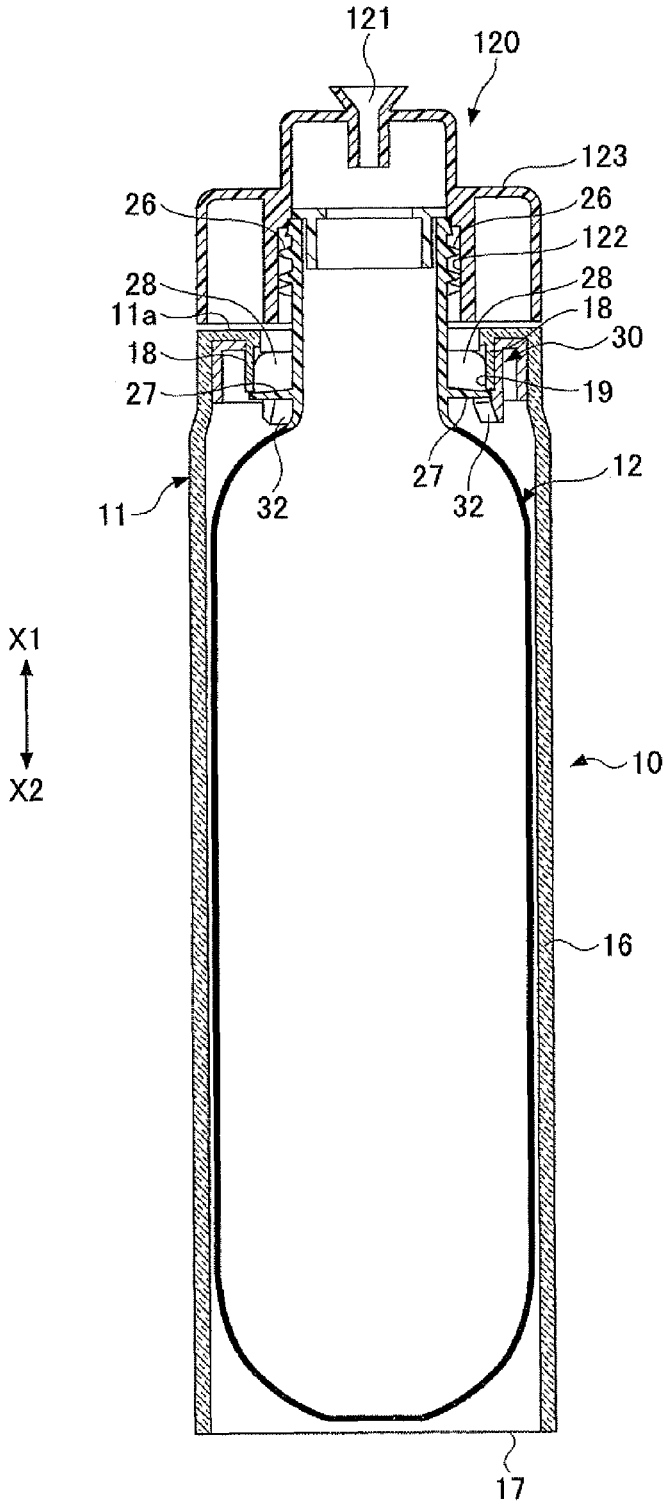
FIG. 26 is a cross-sectional view of the double container of Embodiment 1 of the present invention provided with a discharge nozzle.
Figure 27A:
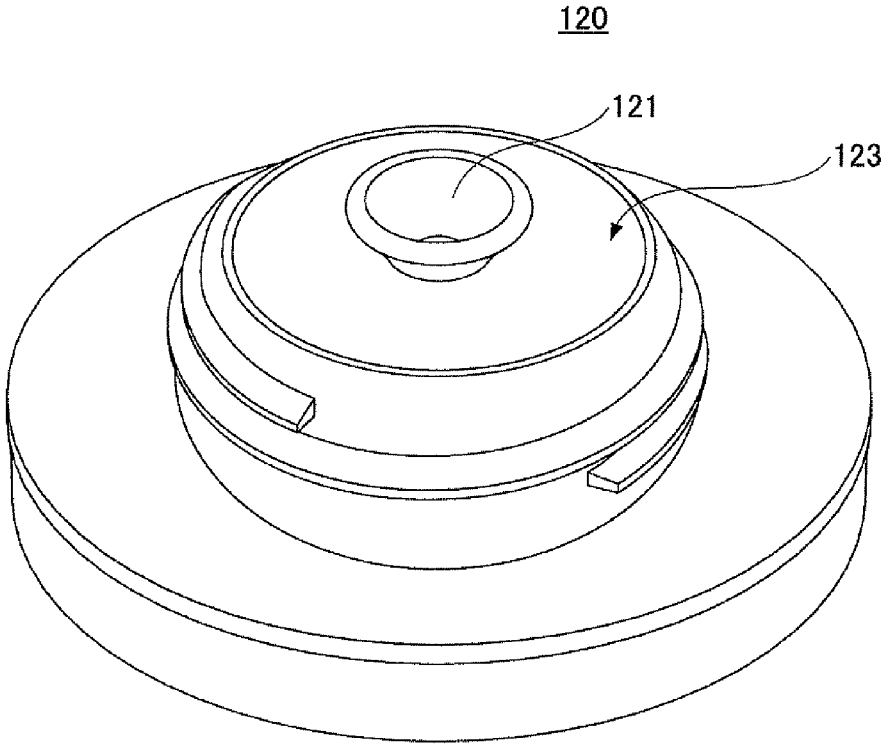
FIG. 27A is a perspective view of a discharge nozzle.
Figure 27B:
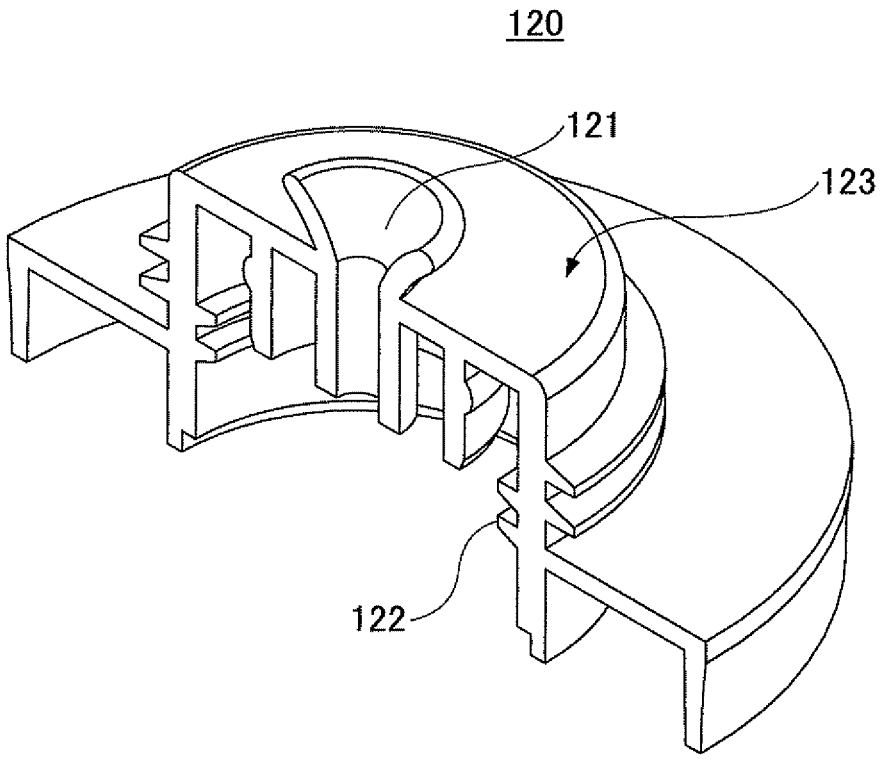
FIG. 27B is a perspective view of the discharge nozzle.

FIG. 26 is a cross-sectional view of the double container 10A of Embodiment 1 provided with a discharge nozzle 120. Referring to FIG. 27A and FIG. 27B in addition to FIG. 26, a nozzle 121 for injecting contents to fill the inner container 42 is provided in a center portion on an upper surface of a body 123. A thread portion 122 to be screwed with a screw portion 26 is formed in the inner periphery of the body 123. As described, the double containers 10A, 10B, 40, 90, 100 and 110 can be used to inject the contents from the discharge nozzle 120.

Although the embodiment have been described, the present invention is not limited to the above embodiments, and various modifications and changes are possible in a scope of the present invention recited in the claims.

This patent application is based on Japanese Priority Patent Application No. 2009-019998 filed on Jan. 30, 2009, Japanese Priority Patent Application No. 2009-164505 filed on Jul. 13, 2009, and Japanese Priority Patent Application No. 2010-011639 filed on Jan. 22, 2010, and the entire contents of Japanese Priority Patent Application No. 2009-019998, Japanese Priority Patent Application No. 2009-164505 and Japanese Priority Patent Application No. 2010-011639 are hereby incorporated herein by reference.

INDUSTRIAL APPLICABILITY

The present invention relates to a double container, an inner container, and an outer container, and more specifically, to a double container formed by temporarily jointing two containers provided by overlapping the two containers, an inner container, and an outer container.

EXPLANATION OF REFERENCE SYMBOLS

10A,10B,40,90,100,110: double container
11,41: outer container
12,42: inner container
13: temporarily jointing mechanism
14: rotation preventing mechanism
16,46: cylindrical body
17,47: bottom opening
18: installing neck
19: rotation preventing recess
20: fixing recess
24,54: installing unit
25: tubular unit
26: screw portion
27: flange
28,35: rotation preventing rib
30: temporarily jointing member
31: fixing portion
32,78: hook
34,55: cogged flange
43A to 44C: temporarily jointing and rotation preventing mechanism
48,71: ceiling
49: bearing portion
50A,50B: penetrating aperture
51: standing portion
56: hanging portion
57A to 57C: operating cap
58A to 58C: spring
59A,59B: hook member
64: hook portion
65: engaging nail
66: pushing piece
70: operating portion
68: contact piece
72: lever portion
74: engaging opening
77: rotary shaft
79: first shear
80: first face
81: second face
82: second shear
83: contact face
84: boss
93: spring
95: fixing thread
96: operated portion
97: positioning dent
98: positioning bump
102: hook portion
106: hanging portion
107: O-ring
120: discharge nozzle

The invention claimed is:

1. An inner container installed inside an outer container, the inner container comprising:

a jointed portion configured to join to a jointing portion faulted in the outer container to prevent the inner container from being separated from the outer container, the jointed portion including a flange formed on a neck portion of the inner container and configured to be joined to a hook portion of the jointing portion of the outer container; and a second engaging portion of the inner container engaged with a first engaging portion formed in the outer container so as to prevent the inner container from rotating relative to the outer container, the second engaging portion including a rib and configured to be engaged with one of a plurality of recesses of the outer container, wherein a wall thickness of the neck portion of the inner container is 0.5 mm to 4.0 mm in a direction perpendicular to a longitudinal direction along a longest side of the inner container, and a wall thickness of a portion other than the neck portion of the inner container is 0.05 mm to 0.3 mm in the direction perpendicular to the longitudinal direction along the longest side of the inner container.

* * * * *